US009665025B2

(12) United States Patent
Moriya

(10) Patent No.: US 9,665,025 B2
(45) **Date of Patent: *May 30, 2017**

(54) TONER, METHOD FOR PRODUCING THE SAME, TONER CARTRIDGE, AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Shiho Moriya, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/877,269

(22) Filed: Oct. 7, 2015

(65) Prior Publication Data

US 2017/0102630 A1 Apr. 13, 2017

(51) Int. Cl.
*G03G 9/08* (2006.01)
*G03G 9/09* (2006.01)
*G03G 9/087* (2006.01)

(52) U.S. Cl.
CPC ..... *G03G 9/092* (2013.01); *G03G 9/081* (2013.01); *G03G 9/0821* (2013.01); *G03G 9/08755* (2013.01); *G03G 9/08782* (2013.01); *G03G 9/091* (2013.01)

(58) Field of Classification Search
CPC ..... G03G 9/092; G03G 9/091; G03G 9/08782
USPC ..... 430/107.1, 108.1, 108.8
See application file for complete search history.

(56) References Cited

U.S. PATENT DOCUMENTS

2011/0183251 A1 7/2011 Katsumata

FOREIGN PATENT DOCUMENTS

JP 5559738 7/2014

*Primary Examiner* — Mark A Chapman
(74) *Attorney, Agent, or Firm* — Amin, Turocy & Watson LLP

(57) ABSTRACT

An object to be achieved by embodiments is to provide a toner having excellent color reproducibility, light resistance, coloring power, low-temperature fixability, storage stability, and long life property, a method for producing the same, a toner cartridge, and an image forming apparatus. A toner according to an embodiment includes toner particles containing a coloring agent, a binder resin, and a specific ester wax. The coloring agent contains at least one pigment (X) selected from C.I. Pigment Red 48, C.I. Pigment Red 48:1, C.I. Pigment Red 48:2, C.I. Pigment Red 48:3, C.I. Pigment Red 48:4, and C.I. Pigment Red 48:5, and C.I. Pigment Red 122 (Y), and the mass ratio of the component (X) to the component (Y) is from 30:70 to 60:40.

10 Claims, 6 Drawing Sheets

| ESTER WAX | CONTENT RATIOS OF ESTER COMPOUNDS HAVING DIFFERENT CARBON NUMBERS IN ESTER WAX [MASS%] | | | | | | | | | | | | $C_n$ | a | CONTENT RATIO OF ESTER COMPOUNDS HAVING CARBON NUMBER OF 38 OR LESS [MASS%] | d/a | c/a | MELTING POINT [°C] | ACID VALUE [mgKOH/g] | HYDROXYL VALUE [mgKOH/g] |
|---|---|---|---|---|---|---|---|---|---|---|---|---|---|---|---|---|---|---|---|---|
| | C32 | C34 | C36 | C38 | C40 | C42 | C44 | C46 | C48 | C50 | C52 | C54 | | | | | | | | |
| A | 0 | 0 | 2.9 | 6.8 | 10.7 | 21.0 | 40.6 | 5.4 | 2.6 | 5.6 | 4.4 | 0 | C44 | 40.6 | 9.7 | 0.781 | 0.517 | 68 | 0.1 | 0.5 |
| B | 0 | 0 | 5.8 | 4.0 | 11.1 | 21.6 | 1.9 | 2.4 | 20.9 | 19.8 | 12.4 | 0.1 | C42 | 21.6 | 9.8 | 0.699 | 0.514 | 63 | 0.1 | 0.5 |
| C | 0 | 0 | 0.1 | 8.3 | 27.7 | 58.0 | 3.3 | 2.3 | 0.2 | 0.1 | 0 | 0 | C42 | 58.0 | 8.4 | 0.621 | 0.478 | 61 | 0.1 | 0.4 |
| D | 0 | 0 | 6.1 | 2.5 | 0.9 | 17.1 | 14.1 | 50.0 | 4.5 | 4.8 | 0 | 0 | C46 | 50.0 | 8.6 | 0.624 | 0.282 | 73 | 0.1 | 0.4 |
| E | 0 | 0 | 0 | 0.5 | 9.8 | 17.8 | 68.0 | 2.4 | 1.5 | 0 | 0 | 0 | C44 | 68.0 | 0.5 | 0.406 | 0.262 | 77 | 0.1 | 0.5 |
| F | 0 | 5.4 | 14.7 | 13.9 | 18.7 | 9.5 | 17.8 | 13.6 | 6.4 | 0 | 0 | 0 | C40 | 18.7 | 34.0 | 1.529 | 0.743 | 63 | 0.1 | 0.3 |
| G | 0 | 0 | 0 | 0.5 | 5.6 | 15.6 | 53.0 | 14.5 | 10.4 | 0.4 | 0 | 0 | C44 | 53.0 | 0.5 | 0.400 | 0.294 | 69 | 0.1 | 0.4 |
| H | 0 | 0 | 0 | 5.9 | 12.1 | 23.5 | 45.0 | 6.8 | 4.3 | 2.4 | 0 | 0 | C44 | 45.0 | 5.9 | 0.791 | 0.522 | 67 | 0.1 | 0.5 |

FIG. 2

| ESTER WAX | CONTENT RATIOS OF ESTER COMPOUNDS HAVING DIFFERENT CARBON NUMBERS IN ESTER WAX [MASS%] | | | | | | | | | | | | $C_n$ | a | CONTENT RATIO OF ESTER COMPOUNDS HAVING CARBON NUMBER OF 38 OR LESS [MASS%] | d/a | c/a | MELTING POINT [°C] | ACID VALUE [mgKOH/g] | HYDROXYL VALUE [mgKOH/g] |
|---|---|---|---|---|---|---|---|---|---|---|---|---|---|---|---|---|---|---|---|---|
| | C32 | C34 | C36 | C38 | C40 | C42 | C44 | C46 | C48 | C50 | C52 | C54 | | | | | | | | |
| A | 0 | 0 | 2.9 | 6.8 | 10.7 | 21.0 | 40.6 | 5.4 | 2.6 | 5.6 | 4.4 | 0 | C44 | 40.6 | 9.7 | 0.781 | 0.517 | 68 | 0.1 | 0.5 |
| B | 0 | 0 | 5.8 | 4.0 | 11.1 | 21.6 | 1.9 | 2.4 | 20.9 | 19.8 | 12.4 | 0.1 | C42 | 21.6 | 9.8 | 0.699 | 0.514 | 63 | 0.1 | 0.5 |
| C | 0 | 0 | 0.1 | 8.3 | 27.7 | 58.0 | 3.3 | 2.3 | 0.2 | 0.1 | 0 | 0 | C42 | 58.0 | 8.4 | 0.621 | 0.478 | 61 | 0.1 | 0.4 |
| D | 0 | 0 | 6.1 | 2.5 | 0.9 | 17.1 | 14.1 | 50.0 | 4.5 | 4.8 | 0 | 0 | C46 | 50.0 | 8.6 | 0.624 | 0.282 | 73 | 0.1 | 0.4 |
| E | 0 | 0 | 0 | 0.5 | 9.8 | 17.8 | 68.0 | 2.4 | 1.5 | 0 | 0 | 0 | C44 | 68.0 | 0.5 | 0.406 | 0.262 | 77 | 0.1 | 0.5 |
| F | 0 | 5.4 | 14.7 | 13.9 | 18.7 | 9.5 | 17.8 | 13.6 | 6.4 | 0 | 0 | 0 | C40 | 18.7 | 34.0 | 1.529 | 0.743 | 63 | 0.1 | 0.3 |
| G | 0 | 0 | 0 | 0.5 | 5.6 | 15.6 | 53.0 | 14.5 | 10.4 | 0.4 | 0 | 0 | C44 | 53.0 | 0.5 | 0.400 | 0.294 | 69 | 0.1 | 0.4 |
| H | 0 | 0 | 0 | 5.9 | 12.1 | 23.5 | 45.0 | 6.8 | 4.3 | 2.4 | 0 | 0 | C44 | 45.0 | 5.9 | 0.791 | 0.522 | 67 | 0.1 | 0.5 |

FIG. 3

| | COLORING AGENT | | | CARBON NUMBER DISTRIBUTION OF ESTER COMPOUNDS IN ESTER WAX EXTRACTED FROM TONER | | | | | |
|---|---|---|---|---|---|---|---|---|---|
| | TYPE | | MASS RATIO | TYPE OF ESTER WAX | $C_n$ | a [MASS%] | CONTENT RATIO OF ESTER COMPOUNDS HAVING CARBON NUMBER OF 38 OR LESS [MASS%] | d/a | c/a |
| EXAMPLE1 | X1 | Y | X1:Y=50:50 | A | C44 | 40.6 | 9.7 | 0.780 | 0.517 |
| EXAMPLE2 | X1 | Y | X1:Y=30:70 | A | C44 | 40.7 | 9.5 | 0.782 | 0.518 |
| EXAMPLE3 | X1 | Y | X1:Y=60:40 | A | C44 | 40.9 | 9.5 | 0.779 | 0.515 |
| EXAMPLE4 | X1 | Y | X1:Y=30:70 | A | C44 | 40.4 | 9.6 | 0.780 | 0.515 |
| EXAMPLE5 | X1 | Y | X1:Y=30:70 | A | C44 | 40.7 | 9.8 | 0.781 | 0.515 |
| EXAMPLE6 | X1 | Y | X1:Y=60:40 | A | C44 | 40.6 | 9.7 | 0.780 | 0.517 |
| EXAMPLE7 | X1 | Y | X1:Y=60:40 | A | C44 | 40.7 | 9.8 | 0.779 | 0.515 |
| EXAMPLE8 | X1 | Y | X1:Y=50:50 | B | C42 | 21.9 | 9.9 | 0.699 | 0.514 |
| EXAMPLE9 | X1 | Y | X1:Y=30:70 | B | C42 | 21.3 | 9.6 | 0.701 | 0.514 |
| EXAMPLE10 | X1 | Y | X1:Y=60:40 | B | C42 | 21.6 | 9.9 | 0.698 | 0.516 |
| EXAMPLE11 | X1 | Y | X1:Y=40:60 | B | C42 | 21.5 | 9.8 | 0.699 | 0.515 |
| EXAMPLE12 | X1 | Y | X1:Y=55:45 | B | C42 | 21.4 | 9.7 | 0.701 | 0.515 |
| EXAMPLE13 | X1 | Y | X1:Y=50:50 | C | C42 | 57.8 | 8.3 | 0.620 | 0.478 |
| EXAMPLE14 | X1 | Y | X1:Y=30:70 | C | C42 | 57.3 | 8.4 | 0.621 | 0.479 |
| EXAMPLE15 | X1 | Y | X1:Y=60:40 | C | C42 | 57.5 | 8.2 | 0.619 | 0.476 |
| EXAMPLE16 | X1 | Y | X1:Y=30:70 | C | C42 | 57.2 | 8.6 | 0.622 | 0.477 |
| EXAMPLE17 | X1 | Y | X1:Y=30:70 | C | C42 | 57.5 | 8.5 | 0.619 | 0.478 |
| EXAMPLE18 | X1 | Y | X1:Y=30:70 | C | C42 | 57.2 | 8.6 | 0.622 | 0.477 |
| EXAMPLE19 | X1 | Y | X1:Y=30:70 | C | C42 | 57.4 | 8.6 | 0.619 | 0.477 |
| EXAMPLE20 | X1 | Y | X1:Y=30:70 | C | C42 | 57.5 | 8.5 | 0.619 | 0.478 |

FIG. 4

| | COLORING AGENT | | | CARBON NUMBER DISTRIBUTION OF ESTER COMPOUNDS IN ESTER WAX EXTRACTED FROM TONER | | | | | |
|---|---|---|---|---|---|---|---|---|---|
| | TYPE | | MASS RATIO | TYPE OF ESTER WAX | $C_n$ | a [MASS%] | CONTENT RATIO OF ESTER COMPOUNDS HAVING CARBON NUMBER OF 38 OR LESS [MASS%] | d/a | c/a |
| EXAMPLE 21 | X1 | Y | X1:Y=60:40 | C | C42 | 57.8 | 8.4 | 0.620 | 0.475 |
| EXAMPLE 22 | X1 | Y | X1:Y=60:40 | C | C42 | 57.4 | 8.7 | 0.621 | 0.478 |
| EXAMPLE 23 | X1 | Y | X1:Y=60:40 | C | C42 | 57.8 | 8.4 | 0.620 | 0.475 |
| EXAMPLE 24 | X1 | Y | X1:Y=60:40 | C | C42 | 57.5 | 8.6 | 0.620 | 0.477 |
| EXAMPLE 25 | X1 | Y | X1:Y=60:40 | C | C42 | 57.4 | 8.7 | 0.621 | 0.478 |
| EXAMPLE 26 | X2 | Y | X2:Y=60:40 | B | C42 | 21.6 | 9.7 | 0.698 | 0.514 |
| EXAMPLE 27 | X1 | Y | X1:Y=50:50 | B | C42 | 21.5 | 9.8 | 0.699 | 0.515 |
| EXAMPLE 28 | X1 | Y | X1:Y=50:50 | D | C44 | 49.9 | 8.5 | 0.622 | 0.283 |
| COMPARATIVE EXAMPLE 1 | X1 | Y | X1:Y=50:50 | E | C44 | 68.4 | 1.2 | 0.406 | 0.258 |
| COMPARATIVE EXAMPLE 2 | X1 | Y | X1:Y=50:50 | F | C40 | 18.1 | 33.6 | 1.507 | 0.508 |
| COMPARATIVE EXAMPLE 3 | X1 | Y | X1:Y=50:50 | G | C44 | 52.4 | 0.2 | 0.398 | 0.294 |
| COMPARATIVE EXAMPLE 4 | X1 | Y | X1:Y=50:50 | H | C44 | 44.9 | 5.9 | 0.791 | 0.524 |
| COMPARATIVE EXAMPLE 5 | X1 | Y | X1:Y=20:80 | B | C42 | 21.8 | 9.9 | 0.699 | 0.514 |
| COMPARATIVE EXAMPLE 6 | X1 | Y | X1:Y=20:80 | B | C42 | 21.5 | 9.8 | 0.700 | 0.515 |
| COMPARATIVE EXAMPLE 7 | X1 | Y | X1:Y=70:30 | B | C42 | 21.2 | 9.6 | 0.698 | 0.516 |
| COMPARATIVE EXAMPLE 8 | X1 | Y | X1:Y=70:30 | B | C42 | 21.6 | 9.7 | 0.699 | 0.516 |

FIG. 5

| | COLOR REPRODUCIBILITY | | | | LIGHT RESISTANCE | | COLORING POWER | | LOW-TEMPERATURE FIXABILITY | | STORAGE STABILITY | | LONG LIFE PROPERTY | | Tg [°C] |
|---|---|---|---|---|---|---|---|---|---|---|---|---|---|---|---|
| | L* | a* | b* | EVALUATION | MEASUREMENT RESULT[%] | EVALUATION | MEASUREMENT RESULT | EVALUATION | MEASUREMENT RESULT[°C] | EVALUATION | MEASUREMENT RESULT [g] | EVALUATION | MEASUREMENT RESULT[mg] | EVALUATION | |
| EXAMPLE 1 | 53 | 73 | 5 | P | 92 | P | 1.40 | P | 111 | P | 2.5 | P | 160 | P | 33.8 |
| EXAMPLE 2 | 55 | 72 | 0 | P | 94 | P | 1.35 | P | 112 | P | 2.6 | P | 150 | P | 33.9 |
| EXAMPLE 3 | 52 | 74 | 8 | P | 91 | P | 1.47 | P | 115 | P | 0.9 | P | 120 | P | 34.2 |
| EXAMPLE 4 | 51 | 72 | 6 | P | 95 | P | 1.55 | P | 113 | P | 2.3 | P | 140 | P | 33.9 |
| EXAMPLE 5 | 59 | 71 | −5 | P | 93 | P | 1.22 | P | 115 | P | 1.0 | P | 120 | P | 34.0 |
| EXAMPLE 6 | 49 | 75 | 13 | P | 92 | P | 1.67 | P | 116 | P | 0.9 | P | 130 | P | 34.1 |
| EXAMPLE 7 | 56 | 73 | 0 | P | 90 | P | 1.31 | P | 114 | P | 1.4 | P | 120 | P | 33.9 |
| EXAMPLE 8 | 53 | 74 | 5 | P | 92 | P | 1.40 | P | 114 | P | 2.9 | P | 140 | P | 34.2 |
| EXAMPLE 9 | 55 | 72 | 0 | P | 94 | P | 1.35 | P | 119 | P | 2.3 | P | 110 | P | 34.3 |
| EXAMPLE 10 | 52 | 74 | 8 | P | 91 | P | 1.47 | P | 121 | P | 2.1 | P | 100 | P | 35.1 |
| EXAMPLE 11 | 54 | 72 | 3 | P | 93 | P | 1.37 | P | 122 | P | 2.0 | P | 120 | P | 35.5 |
| EXAMPLE 12 | 52 | 73 | 7 | P | 91 | P | 1.45 | P | 119 | P | 2.8 | P | 110 | P | 34.4 |
| EXAMPLE 13 | 53 | 73 | 5 | P | 92 | P | 1.39 | P | 123 | P | 0.3 | P | 80 | P | 43.3 |
| EXAMPLE 14 | 54 | 72 | 0 | P | 94 | P | 1.34 | P | 121 | P | 1.0 | P | 110 | P | 41.4 |
| EXAMPLE 15 | 52 | 73 | 8 | P | 91 | P | 1.47 | P | 122 | P | 0.7 | P | 90 | P | 40.8 |
| EXAMPLE 16 | 50 | 72 | 6 | P | 95 | P | 1.55 | P | 123 | P | 1.1 | P | 100 | P | 40.8 |
| EXAMPLE 17 | 59 | 71 | −5 | P | 93 | P | 1.22 | P | 122 | P | 0.7 | P | 90 | P | 41.0 |
| EXAMPLE 18 | 51 | 72 | 5 | P | 95 | P | 1.49 | P | 123 | P | 0.6 | P | 80 | P | 39.5 |
| EXAMPLE 19 | 58 | 71 | −3 | P | 93 | P | 1.23 | P | 121 | P | 0.9 | P | 100 | P | 39.0 |
| EXAMPLE 20 | 57 | 71 | −2 | P | 94 | P | 1.24 | P | 120 | P | 1.0 | P | 110 | P | 39.2 |

FIG. 6

| | COLOR REPRODUCIBILITY | | | | LIGHT RESISTANCE | | COLORING POWER | | LOW-TEMPERATURE FIXABILITY | | STORAGE STABILITY | | LONG LIFE PROPERTY | | Tg [°C] |
|---|---|---|---|---|---|---|---|---|---|---|---|---|---|---|---|
| | L* | a* | b* | EVALUATION | MEASUREMENT RESULT[%] | EVALUATION | MEASUREMENT RESULT | EVALUATION | MEASUREMENT RESULT[°C] | EVALUATION | MEASUREMENT RESULT[g] | EVALUATION | MEASUREMENT RESULT[mg] | EVALUATION | |
| EXAMPLE 21 | 48 | 75 | 13 | P | 92 | P | 1.67 | P | 124 | P | 1.7 | P | 165 | P | 35.1 |
| EXAMPLE 22 | 56 | 73 | 0 | P | 90 | P | 1.31 | P | 123 | P | 0.5 | P | 120 | P | 34.8 |
| EXAMPLE 23 | 48 | 75 | 12 | P | 92 | P | 1.57 | P | 122 | P | 0.8 | P | 150 | P | 35.1 |
| EXAMPLE 24 | 55 | 74 | 2 | P | 90 | P | 1.32 | P | 121 | P | 0.8 | P | 100 | P | 34.9 |
| EXAMPLE 25 | 54 | 74 | 5 | P | 90 | P | 1.32 | P | 120 | P | 0.9 | P | 110 | P | 34.8 |
| EXAMPLE 26 | 53 | 74 | 2 | P | 91 | P | 1.48 | P | 121 | P | 1.0 | P | 110 | P | 36.3 |
| EXAMPLE 27 | 53 | 73 | 6 | P | 92 | P | 1.40 | P | 122 | P | 1.3 | P | 100 | P | 36.0 |
| EXAMPLE 28 | 52 | 73 | 5 | P | 92 | P | 1.40 | P | 124 | P | 0.6 | P | 90 | P | 37.0 |
| COMPARATIVE EXAMPLE 1 | 52 | 69 | 7 | F | 92 | P | 1.33 | P | 130 | F | 4.0 | F | 250 | F | 36.9 |
| COMPARATIVE EXAMPLE 2 | 53 | 73 | 5 | P | 92 | P | 1.40 | P | 117 | P | 10.0 | F | 320 | F | 33.7 |
| COMPARATIVE EXAMPLE 3 | 51 | 69 | 7 | F | 92 | P | 1.33 | P | 135 | F | 0.7 | P | 100 | P | 42.0 |
| COMPARATIVE EXAMPLE 4 | 53 | 73 | 5 | P | 92 | P | 1.40 | P | 127 | F | 2.7 | P | 410 | F | 35.5 |
| COMPARATIVE EXAMPLE 5 | 60 | 69 | −9 | F | 94 | P | 1.18 | F | 119 | P | 1.3 | P | 130 | P | 34.9 |
| COMPARATIVE EXAMPLE 6 | 56 | 69 | −1 | F | 95 | P | 1.32 | P | 120 | P | 1.1 | P | 140 | P | 35.9 |
| COMPARATIVE EXAMPLE 7 | 51 | 74 | 11 | F | 86 | F | 1.38 | P | 121 | P | 0.8 | P | 100 | P | 36.5 |
| COMPARATIVE EXAMPLE 8 | 43 | 76 | 16 | F | 88 | F | 1.74 | P | 124 | P | 1.2 | P | 150 | P | 37.0 |

TONER, METHOD FOR PRODUCING THE SAME, TONER CARTRIDGE, AND IMAGE FORMING APPARATUS

FIELD

Embodiments described herein relate generally to a toner, a method for producing the same, a toner cartridge, and an image forming apparatus.

BACKGROUND

An electrostatic image and a magnetic latent image in an electrophotographic method, an electrostatic printing method, a magnetic recording method, or the like are developed using a toner. Such a toner is required to have color reproducibility for accurately reproducing a color. Further, such a toner is required to have low-temperature fixability from the viewpoint of energy saving in consideration of environment recently.

As a toner having excellent color reproducibility and low-temperature fixability, a toner containing a coloring agent in which the blending ratio of an azo-lake pigment and a quinacridone pigment is defined and a crystalline polyester resin is known.

Further, a toner, which contains an ester wax and a crystalline polyester resin, and in which the carbon number distribution of ester compounds constituting the ester wax is broadened, and the ratio of ester compounds having a small carbon number is controlled, is known. This toner has excellent low-temperature fixability, and the deposition of the ester wax when the toner is left at a high temperature is prevented.

However, in order to respond to the recent increase in the operating speed of an image forming apparatus and increase in the quality of images formed by an image forming apparatus, a toner is required to have further enhanced dispersibility of a pigment or the like and a further improved long life property enabling a high-quality image to be obtained over a long period of time. In addition, a toner is also required to have further improved color reproducibility, coloring power, low-temperature fixability, storage stability, and light resistance.

DESCRIPTION OF THE DRAWINGS

FIG. 2 shows the measurement results of the content ratios of ester compounds having different carbon numbers in ester waxes.

FIGS. 3 and 4 show the measurement results of $C_n$, a, and d of ester compounds in ester waxes extracted from toners of Examples.

FIGS. 5 and 6 show the evaluation results of Examples.

DETAILED DESCRIPTION

Figure 1:
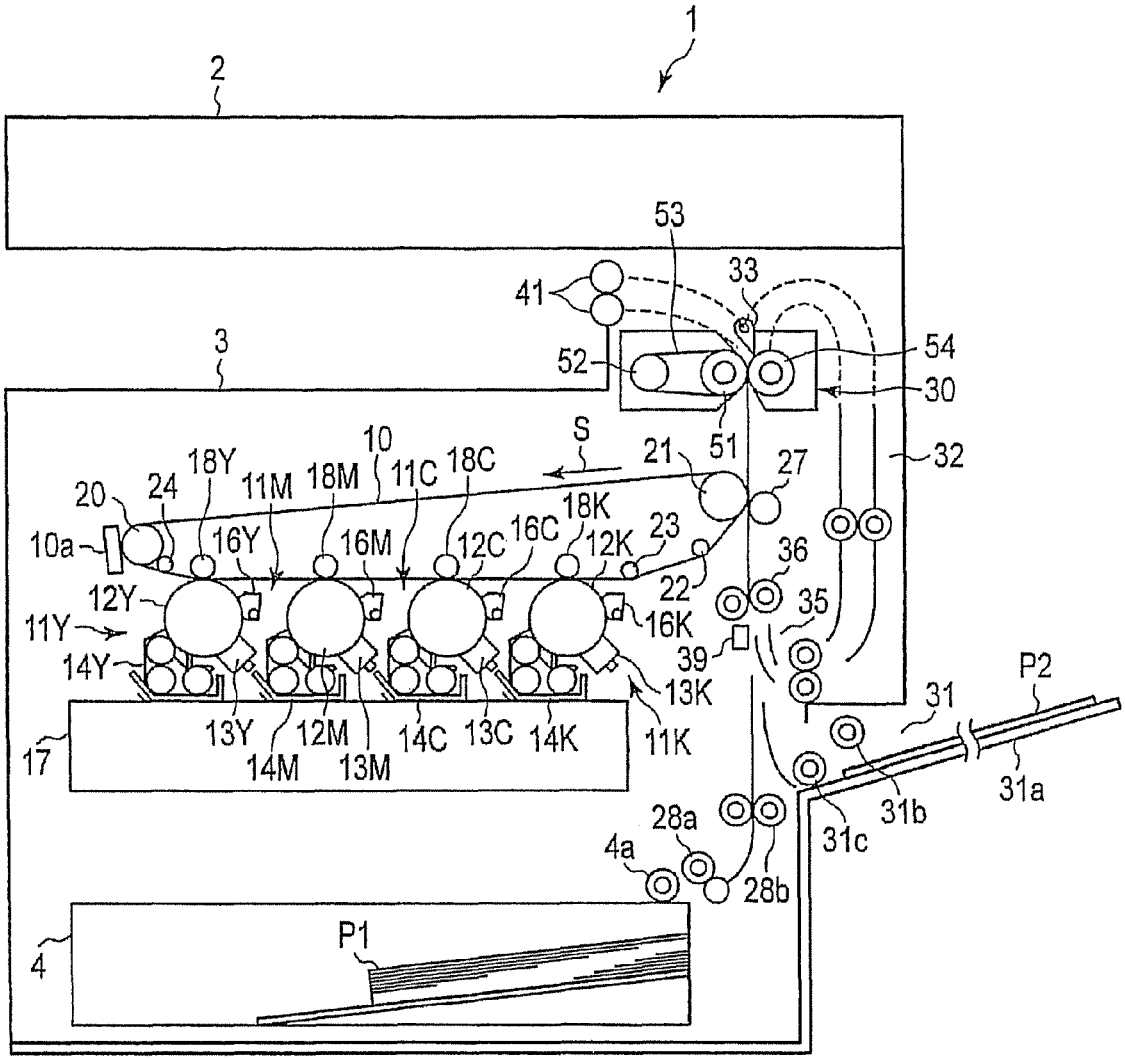
FIG. 1 shows one embodiment of an image forming apparatus.

In general, an object to be achieved by embodiments is to provide a toner having excellent color reproducibility, light resistance, coloring power, low-temperature fixability, storage stability, and long life property, a method for producing the same, a toner cartridge, and an image forming apparatus.

A toner according to an embodiment includes toner particles containing a coloring agent, a binder resin, and an ester wax. The coloring agent contains at least one pigment (hereinafter also referred to as "component (X)") selected from C.I. Pigment Red 48, C.I. Pigment Red 48:1, C.I. Pigment Red 48:2, C.I. Pigment Red 48:3, C.I. Pigment Red 48:4, and C.I. Pigment Red 48:5, and C.I. Pigment Red 122 (hereinafter also referred to as "component (Y)"). The mass ratio of the component (X) to the component (Y) in the coloring agent is from 30:70 to 60:40. The ester wax is composed of two or more ester compounds represented by the following general formula (I) and having different carbon numbers. The content of an ester compound having a carbon number of ($C_n$) whose content in the ester wax is the highest is from 20 to 58% by mass of the total mass of the ester wax. The content of ester compounds having a carbon number of 38 or less in the ester wax is 10% by mass or less of the total mass of the ester wax. The ester wax further satisfies the following formula (1).

$$R^1COOR^2 \quad (I)$$

In the formula (I), $R^1$ and $R^2$ each represent an alkyl group, and the total carbon number of $R^1$ and $R^2$ is from 31 to 53.

$$0.619 \leq d/a \leq 0.783 \quad (1)$$

a in the formula (1) represents the content of the ester compound having a carbon number of ($C_n$) in the ester wax. d in the formula (1) represents the total content of an ester compound having a carbon number of ($C_n$−4) and an ester compound having a carbon number of ($C_n$−2) in the ester wax.

Hereinafter, a toner according to an embodiment will be described.

A toner according to an embodiment includes toner particles containing a coloring agent, a binder resin, and an ester wax.

The particle group of the toner particles has a volume average diameter of, for example, 3 to 20 μm. If the volume average diameter is less than 3 μm, a desired amount of development is hardly obtained. If the volume average diameter exceeds 20 μm, the reproducibility of a fine image or graininess may be deteriorated. The volume average diameter is preferably from 4 to 10 μm, more preferably from 4 to 8 μm.

The toner according to the embodiment is used as, for example, an electrophotographic toner.

The coloring agent will be described.

The coloring agent of the embodiment contains at least one pigment (component (X)) selected from C.I. Pigment Red 48, C.I. Pigment Red 48:1, C.I. Pigment Red 48:2, C.I. Pigment Red 48:3, C.I. Pigment Red 48:4, and C.I. Pigment Red 48:5, and C.I. Pigment Red 122 (component (Y)). The mass ratio of the component (X) to the component (Y) in the coloring agent is from 30:70 to 60:40.

The component (X) has excellent color developability and coloring power, but has a strong redness and poor light resistance. The component (Y) has high chroma and excellent light resistance, but has a strong blueness and poor coloring power. By using the component (X) and the component (Y) in combination, and setting the mass ratio of the component (X) to the component (Y) within the above range, the hue is controlled to fall within an appropriate range. Further, the coloring power and light resistance of the coloring agent are enhanced. If the mass ratio of the component (X) is less than the above lower limit, sufficient coloring power cannot be obtained. Further, the blueness increases, so that the color reproduction range of red which is reproduced by superposition of a yellow toner is reduced. If the mass ratio of the component (X) exceeds the above upper limit, sufficient light resistance cannot be obtained.

Further, the redness increases, so that the color reproduction range of blue which is reproduced by superposition of a cyan toner is reduced. The mass ratio (X:Y) of the component (X) to the component (Y) is preferably from 40:60 to 60:40, more preferably from 45:55 to 55:45.

Among the components (X), C.I. Pigment Red 48:3 is preferred. By using C.I. Pigment Red 48:3, the hue is easily controlled to fall within an appropriate range. Further, a toner having excellent light resistance is easily obtained.

The coloring agent may contain a coloring agent other than the component (X) and the component (Y). Examples of the coloring agent other than the component (X) and the component (Y) include Indofast Orange, Irgaj in Red, Carmine FB, Permanent Bordeaux FRR, Pigment Orange R, Lithol Red 2G, Lake Red C, Rhodamine FB, Rhodamine B Lake, Du Pont Oil Red, Rose Bengal, and Quinacridone. Further, additional examples of the coloring agent other than the component (X) and the component (Y) include C.I. Pigment Orange 48 and 49, C.I. Pigment Red 5, 12, 31, 49, 53, 53:1, 53:2, 53:3, 57, 57:1, 81, 81:4, 146, 150, 177, 185, 202, 206, 207, 209, 238, and 269, C.I. Pigment Violet 1, 19, and 42, and C.I. Acid Red 52 as identified by Colour Index Constitution Numbers.

The content of the coloring agent is not particularly limited, but is preferably from 4 to 12% by mass, more preferably from 5 to 11% by mass, further more preferably from 6 to 11% by mass of the total mass of the toner particles. When the content of the coloring agent is 4% by mass or more of the total mass of the toner particles, the color reproducibility or light resistance is easily enhanced. When the content of the coloring agent is 12% by mass or less of the total mass of the toner particles, the dispersibility of the coloring agent is enhanced, and the low-temperature fixability and long life property are easily improved.

Further, the total content of the component (X) and the component (Y) in the coloring agent is not particularly limited, but is preferably from 30 to 100% by mass, more preferably from 50 to 100% by mass of the total mass of the coloring agent. When the total content of the component (X) and the component (Y) in the coloring agent is within the above range, the color reproducibility, light resistance, and coloring power are easily enhanced.

The binder resin will be described.

Examples of the binder resin of the embodiment include a polyester resin, a polystyrene resin, a polyurethane resin, and an epoxy resin. Examples of the polyester resin include an amorphous polyester resin and a crystalline polyester resin. The binder resin of the embodiment preferably contains a crystalline polyester resin. Further, in the binder resin of the embodiment, it is preferred to use an amorphous polyester resin and a crystalline polyester resin in combination. Incidentally, in the embodiment, a polyester resin having a ratio of the softening point to the melting temperature (softening point/melting temperature) of 0.8 to 1.2 is referred to as "crystalline polyester resin", and a polyester resin other than this is referred to as "amorphous polyester resin".

The amorphous polyester resin will be described.

As the amorphous polyester resin, an amorphous polyester resin obtained by condensation polymerization between a dihydric or higher hydric alcohol and a divalent or higher valent carboxylic acid is exemplified. Examples of the divalent or higher valent carboxylic acid include a divalent or higher valent carboxylic acid, an acid anhydride thereof, and an ester thereof. Examples of the ester include a lower alkyl (C1-C12 alkyl) ester of a divalent or higher valent carboxylic acid.

Examples of the dihydric alcohol include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, and an alkylene oxide adduct of bisphenol A. As the alkylene oxide adduct of bisphenol A, a compound in which 1 to 10 moles on average of a C2-C3 alkylene oxide is added to bisphenol A is exemplified. Examples of the alkylene oxide adduct of bisphenol A include polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane, and polyoxypropylene(6)-2,2-bis(4-hydroxyphenyl)propane. As the dihydric alcohol, an alkylene oxide adduct of bisphenol A is preferred.

Examples of the trihydric or higher hydric alcohol include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. As the trihydric or higher hydric alcohol, sorbitol, 1,4-sorbitan, pentaerythritol, glycerol, and trimethylolpropane are preferred.

Among these dihydric or higher hydric alcohols, any one alcohol may be used alone, or two or more alcohols may be used in combination. As the dihydric or higher hydric alcohol, an alkylene oxide adduct of bisphenol A is preferred.

Examples of the divalent carboxylic acid include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and succinic acid substituted with an alkyl group or an alkenyl group. As the succinic acid substituted with an alkyl group or an alkenyl group, succinic acid substituted with a C2-C20 alkyl group or a C2-C20 alkenyl group is exemplified, and examples thereof include n-dodecenyl succinic acid and n-dodecyl succinic acid. Further, an acid anhydride of the above-mentioned divalent carboxylic acid or an ester of the above-mentioned divalent carboxylic acid may be used. As the divalent carboxylic acid, maleic acid, fumaric acid, terephthalic acid, and succinic acid substituted with a C2-C20 alkenyl group are preferred.

Examples of the trivalent or higher valent carboxylic acid include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, enpol trimer acid, an acid anhydride thereof, and an ester thereof. As the trivalent or higher valent carboxylic acid, 1,2,4-benzenetricarboxylic acid (trimellitic acid), an acid anhydride thereof, or a lower alkyl (C1-C12 alkyl) ester thereof is preferred.

Among the above-mentioned divalent or higher valent carboxylic acids, any one carboxylic acid may be used alone, or two or more carboxylic acids may be used in combination.

When condensation polymerization between the above-mentioned dihydric or higher hydric alcohol and the above-mentioned divalent or higher valent carboxylic acid is performed, in order to accelerate the reaction, a commonly used catalyst may be used. Examples of the catalyst include dibutyltin oxide, a titanium compound, a dialkoxytin(II), tin(II) oxide, a fatty acid tin(II), tin(II) dioctanoate, and tin(II) distearate.

The crystalline polyester resin will be described.

As the crystalline polyester resin, a crystalline polyester resin obtained by condensation polymerization between a dihydric or higher hydric alcohol and a divalent or higher valent carboxylic acid is exemplified.

Examples of the dihydric or higher hydric alcohol include ethylene glycol, 1,2-propylene glycol, 1,3-propylene glycol, 1,4-butanediol, 1,5-pentanediol, 1,6-hexanediol, neopentyl glycol, 1,4-butenediol, polyoxypropylene, polyoxyethylene, glycerin, pentaerythritol, and trimethylolpropane. As the dihydric or higher hydric alcohol, 1,4-butanediol and 1,6-hexanediol are preferred.

Examples of the divalent or higher valent carboxylic acid include adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, succinic acid substituted with an alkyl group or an alkenyl group, cyclohexanedicarboxylic acid, trimellitic acid, pyromellitic acid, an acid anhydride thereof, and an ester thereof. As the succinic acid substituted with an alkyl group or an alkenyl group, succinic acid substituted with a C2-C20 alkyl group or a C2-C20 alkenyl group is exemplified, and examples thereof include n-dodecenyl succinic acid and n-dodecyl succinic acid. Among these, fumaric acid is preferred.

The endothermic peak temperature of the crystalline polyester resin as measured by a differential scanning calorimeter (DSC) is not particularly limited, but is preferably from 78 to 110° C., more preferably from 80 to 107° C., further more preferably from 83 to 105° C. If the endothermic peak temperature is too low, the storage stability of the toner may be deteriorated. If the endothermic peak temperature is too high, the fixability of the toner may be deteriorated.

The content of the crystalline polyester resin is not particularly limited, but is preferably from 3 to 32% by mass, more preferably from 5 to 30% by mass, furthermore preferably from 7 to 28% by mass of the total mass of the toner particles.

When the content of the crystalline polyester resin is 3% by mass or more of the total mass of the toner particles, the low-temperature offset resistance is easily improved. When the content of the crystalline polyester resin is 32% by mass or less of the total mass of the toner particles, the storage stability in a high temperature environment is easily enhanced.

The ester wax will be described.

The ester wax of the embodiment is composed of two or more ester compounds represented by the following general formula (I) and having different carbon numbers.

$$R^1COOR^2 \quad (I)$$

In the formula (I), $R^1$ and $R^2$ each represent an alkyl group, and the total carbon number of $R^1$ and $R^2$ is from 31 to 53.

The content of an ester compound having a carbon number of ($C_n$) whose content in the ester wax is the highest is from 20 to 58% by mass, preferably from 20 to 55% by mass, more preferably from 20 to 50% by mass of the total mass of the ester wax. If the content of the ester compound having a carbon number of ($C_n$) exceeds 58% by mass, the ester wax is deposited from the toner particles when the toner is left at a high temperature, and the storage stability of the toner is deteriorated.

The content of ester compounds having a carbon number of 38 or less in the ester wax is 10% by mass or less of the total mass of the ester wax. The content of ester compounds having a carbon number of 38 or less may be 0% by mass, or may exceed 0% by mass. The content of ester compounds having a carbon number of 38 or less is preferably from 0.1 to 8% by mass, more preferably 0.1 to 5% by mass of the total mass of the ester wax. If the content of ester compounds having a small carbon number of 38 or less exceeds 10% by mass of the total mass of the ester wax, the ester wax is deposited from the toner particles when the toner is left at a high temperature, and the storage stability of the toner is deteriorated.

The ester wax further satisfies the following formula (1).

$$0.619 \le d/a \le 0.783 \quad (1)$$

a in the formula (1) represents the content of the ester compound having a carbon number of ($C_n$) in the ester wax. d in the formula (1) represents the total content of an ester compound having a carbon number of ($C_n$−4) and an ester compound having a carbon number of ($C_n$−2) in the ester wax.

The d/a ratio is from 0.619 to 0.783, preferably from 0.625 to 0.780. If the d/a ratio exceeds 0.783, the carbon number distribution of ester compounds constituting the ester wax is too broad. As a result, the low-temperature fixability of the toner is improved, however, the ester wax is hardly dispersed, and therefore, the storage stability of the toner is deteriorated. If the d/a ratio is less than 0.619, the carbon number distribution of ester compounds constituting the ester wax is too sharp. As a result, the low-temperature fixability of the toner and the dispersibility of the coloring agent become insufficient.

The $C_n$ is preferably a carbon number of 40 to 48, more preferably a carbon number of 42 to 46. If the $C_n$ is the above-mentioned preferred carbon number, the storage stability and long life property of the toner are easily enhanced.

The ratio (c/a) of the content c of the ester compound having a carbon number of ($C_n$−2) in the ester wax to the a preferably satisfies the following formula: $0.281 \le c/a \le 0.518$, more preferably satisfies the following formula: $0.290 \le c/a \le 0.510$. If the c/a ratio is within the above preferred range, the low-temperature fixability and the dispersibility of the coloring agent are easily enhanced.

Further, the endothermic peak temperature of the ester wax as measured by a differential scanning calorimeter is not particularly limited, but is preferably from 60 to 75° C., more preferably from 62 to 73° C., further more preferably from 63 to 72° C. If the endothermic peak temperature is too high, the fixability may be deteriorated.

The content of the ester wax is not particularly limited, but is preferably from 3 to 13% by mass, more preferably from 5 to 12% by mass, further more preferably from 6 to 11% by mass of the total mass of the toner particles. When the content of the ester wax is 3% by mass or more of the total mass of the toner particles, the low-temperature offset resistance and high-temperature offset resistance are easily enhanced. When the content of the ester wax is 13% by mass or less of the total mass of the toner particles, toner scattering and toner adhesion to a photoconductor are reduced, and the storage stability in a high temperature environment is easily enhanced.

The contents of ester compounds having different carbon numbers in the ester wax can be measured by, for example, mass analysis with FD-MS (Field Desorption Mass Spectrometry). The total ion intensity of the ester compounds having different carbon numbers in the ester wax obtained by the measurement with FD-MS described above is determined to be 100. The relative values of the ion intensities of the ester compounds having different carbon numbers with respect to the total ion intensity are calculated, and the relative values are defined as the contents of the ester compounds having different carbon numbers in the ester wax. Further, the carbon number of an ester compound having a carbon number showing the highest relative value is defined as $C_n$.

The ester wax of the embodiment can be synthesized by, for example, an esterification reaction from a long-chain alkyl carboxylic acid and a long-chain alkyl alcohol. As the long-chain alkyl carboxylic acid, a C12-C40 alkyl carboxylic acid is preferred, and a C14-C30 alkyl carboxylic acid is more preferred. Examples of the long-chain alkyl carboxylic acid include palmitic acid, stearic acid, arachidonic acid, behenic acid, lignoceric acid, cerotic acid, and montanoic acid. As the long-chain alkyl alcohol, a C12-C40 alkyl alcohol is preferred, and a C14-C30 alkyl alcohol is more preferred. Examples of the long-chain alkyl alcohol include palmityl alcohol, stearyl alcohol, arachidyl alcohol, behenyl alcohol, lignoceryl alcohol, ceryl alcohol, and montanyl alcohol.

In rice wax, carnauba wax, or the like used conventionally, the carbon number of an ester compound whose content in the wax is the highest is large, and the content of the ester compound is less than 20% by mass. Such a wax has poor low-temperature fixability.

The ester compounds constituting the ester wax to be used in the embodiment have a carbon number distribution as described above. According to this, the ester wax of the embodiment is favorably dispersed in the toner particles. Further, the Tg of the toner containing such an ester wax is decreased, so that the toner has favorable fixability at a low temperature.

In the embodiment, as the coloring agent, the component (X) and the component (Y) are used in combination. Among these components, the component (Y) is hardly uniformly dispersed in the binder resin. If the uniform dispersibility of the component (Y) is deteriorated, the chroma and brightness are decreased. In particular, in the case of a magenta toner containing the component (Y), when the uniform dispersibility of the component (Y) is deteriorated, the color reproduction range of red which is reproduced by superposition of a yellow toner is largely reduced. When a crystalline polyester resin is used as the binder resin, the low-temperature fixability of the toner is easily enhanced, but the dispersibility of the coloring agent is further deteriorated. The ester wax of the embodiment is configured such that the d/a ratio is 0.619 or more, and the range of the carbon number of ester compounds constituting the ester wax is broad. According to this, the surface of the coloring agent can be easily wet when dispersing the coloring agent, and the dispersibility of the coloring agent can be enhanced. Further, the ester wax containing a part of the coloring agent is easily diffused in the binder resin. Due to this, the dispersibility of the component (Y) can be enhanced to the same level as the component (X), and thus, a toner in which the entire coloring agent is uniformly dispersed can be obtained. As a result, the toner according to the embodiment has excellent color reproducibility. Further, the deposition of the coloring agent on the surfaces of the toner particles is prevented to improve the charging stability, and therefore, a high-quality image can be obtained over a long period of time.

The toner particles of the embodiment may contain another component as needed in addition to the coloring agent, the binder resin, and the ester wax. Examples of the another component include a charge control agent, a surfactant, a basic compound, an aggregating agent, and a pH adjusting agent.

The charge control agent will be described.

The charge control agent controls the chargeability of the toner and is used for facilitating the transfer of the toner onto a recording medium such as paper. Examples of the charge control agent include a metal-containing azo compound, a metal-containing salicylic acid derivative compound, a hydrophobized metal oxide material, and a clathrate compound of a polysaccharide. As the metal-containing azo compound, a metal-containing azo compound, in which the metal is a complex or a complex salt of iron, cobalt, or chromium, or a mixture thereof, is preferred. As the metal-containing salicylic acid derivative compound or the hydrophobized metal oxide material, a metal-containing salicylic acid derivative compound or a hydrophobized metal oxide material, in which the metal is a complex or a complex salt of zirconium, zinc, chromium, or boron, or a mixture thereof, is preferred. As the clathrate compound of a polysaccharide, a clathrate compound of a polysaccharide containing aluminum and magnesium is preferred.

The content of the charge control agent is not particularly limited, but can be set to 0.5 to 3 parts by mass with respect to 100 parts by mass of the binder resin. If the addition amount of the charge control agent is less than 0.5 parts by mass, the charge amount of a developer is decreased, so that toner scattering in a machine is increased, and therefore, the long life property may be deteriorated. If the addition amount of the charge control agent exceeds 3 parts by mass, the charge amount of a developer is increased, so that the image density may be insufficient. Further, the carrier surface in a developer may be contaminated, so that the charging may become unstable.

A method for producing the toner particles will be described.

The toner particles of the embodiment can be produced by, for example, a kneading pulverization method or a chemical method.

As the method for producing the toner particles of the embodiment, a kneading pulverization method is preferred.

As the kneading pulverization method, for example, a production method including a mixing step of mixing the coloring agent, the binder resin, and the ester wax, thereby obtaining a mixture, a kneading step of melt-kneading the mixture, thereby obtaining a kneaded material, and a pulverizing step of pulverizing the kneaded material, thereby obtaining a pulverized material can be exemplified. The production method may include a classification step of classifying the pulverized material as needed.

In the mixing step, starting materials of the toner particles are mixed, whereby a mixture is formed. As a mixing machine to be used in the mixing step, for example, a Henschel mixer (manufactured by Mitsui Mining Co., Ltd.); a Super mixer (manufactured by Kawata MFG Co., Ltd.); a Ribocone (manufactured by Okawara Corporation); a Nauta mixer, a Turbulizer, and a Cyclomix (all of which are manufactured by Hosokawa Micron Corporation); a Spiralpin mixer (manufactured by Pacific Machinery & Engineering Co., Ltd.); and a Lodige mixer (manufactured by Matsubo Corporation) can be exemplified.

In the kneading step, the mixture formed in the mixing step is melt-kneaded, whereby a kneaded material is formed. As a kneading machine to be used in the kneading step, for example, a KRC kneader (manufactured by Kurimoto, Ltd.); a Buss Ko-Kneader (manufactured by Buss AG); a TEM type extruder (manufactured by Toshiba Machine Co., Ltd.); a TEX twin-screw kneading machine (manufactured by The Japan Steel Works, Ltd.); a PCM kneading machine (manufactured by Ikegai, Ltd.); a three-roll mill, a mixing roll mill, and a kneader (all of which are manufactured by Inoue Mfg., Inc.); a Kneadex (manufactured by Mitsui Mining Co., Ltd.); an MS type pressure kneader and a kneader-ruder (both of which are manufactured by Moriyama Company Ltd.); and a Banbury mixer (manufactured by Kobe Steel, Ltd.) can be exemplified.

In the pulverizing step, the kneaded material formed in the kneading step is pulverized, whereby a pulverized material is formed. As a pulverizing machine to be used in the pulverizing step, for example, a hammer mill, a cutter mill, a jet mill, a roller mill, and a ball mill can be exemplified. The pulverized material obtained by the pulverizing machine may be further finely pulverized. As a pulverizing machine to be used for further finely pulverizing the pulverized material, for example, a counter jet mill, a Micron jet, and an Inomizer (all of which are manufactured by Hosokawa Micron Corporation); an IDS type mill and a PJM jet pulverizer (both of which are manufactured by Nippon Pneumatic Mfg. Co., Ltd.); a Cross Jet mill (manufactured by Kurimoto, Ltd.); an Ulmax (manufactured by Nisso Engineering Co., Ltd.); an SK Jet-O-Mill (manufactured by Seisin Enterprise Co., Ltd.); a Kriptron (manufactured by Kawasaki Heavy Industries, Ltd.); and a Turbo mill (manufactured by Turbo Kogyo Co., Ltd.) can be exemplified. The pulverized material obtained in the pulverizing step may be directly used as the toner particles, or may be subjected to a classification step as needed, and then used as the toner particles.

In the classification step, the pulverized material obtained in the pulverizing step is classified. As a classifying machine to be used in the classification step, for example, a Classiel, a Micron classifier, and a Spedic classifier (all of which are manufactured by Seisin Enterprises Co., Ltd.); a Turbo classifier (manufactured by Nisshin Engineering Co., Ltd.); a Micron separator, a Turboplex (ATP), and a TSP separator (all of which are manufactured by Hosokawa Micron Corporation); an Elbow-Jet (manufactured by Nittetsu Mining Co., Ltd.); a Dispersion separator (manufactured by Nippon Pneumatic Mfg. Co., Ltd.); and a YM Microcut (manufactured by Yasukawa Shoji K.K.) can be exemplified.

Further, as the kneading pulverization method, for example, the following method can be exemplified other than the above-mentioned method. The coloring agent, the binder resin, and the ester wax are mixed, whereby a mixture is formed. The mixture is melt-kneaded, whereby a kneaded material is formed. The kneaded material is pulverized, whereby coarsely granulated moderately pulverized particles are formed. The moderately pulverized particles are mixed with an aqueous solvent, whereby a mixed liquid is prepared. The mixed liquid is subjected to mechanical shearing, whereby a fine particle dispersion liquid is formed. The fine particles in the fine particle dispersion liquid are aggregated, whereby toner particles are formed.

The coloring agent of the embodiment contains the component (Y). The component (Y) is hardly dispersed uniformly in the binder resin. When a crystalline polyester resin is used as the binder resin, the dispersibility of the coloring agent is further deteriorated. In the related art, when toner particles were produced using a coloring agent containing the component (Y) as the coloring agent, a step of dispersing the coloring agent beforehand using a part of the binder resin to be added to the toner particles was needed. As the step, for example, a step of performing a flushing treatment for the coloring agent, or a step of preparing a master batch by melt-kneading the coloring agent and the binder resin at a high concentration can be exemplified. The concentration of the coloring agent in the master batch is appropriately adjusted. The concentration of the coloring agent in the master batch is set to be higher than the concentration of the coloring agent in the toner particles, and set to, for example, 20 to 70% by mass. Further, generally, the flushing treatment is a treatment in which a water-containing paste of the coloring agent and the binder resin are mixed by a kneader such as a flusher to form a mixture, and thereafter, water is removed from the mixture, whereby the coloring agent dispersed in the binder resin is obtained.

In the embodiment, by using the ester wax composed of ester compounds having a specific carbon number distribution, the coloring agent containing the component (Y) can be favorably uniformly dispersed. Due to this, the above-mentioned step of performing a flushing treatment and step of preparing a master batch can be omitted. Further, for example, in the step of performing a flushing treatment, due to residual water, impurities, etc., the chargeability and color reproducibility of the toner particles may be deteriorated. In the step of preparing a master batch, because the binder resin is subjected to high shearing at a high concentration, the high-temperature offset of the toner particles may be deteriorated. In the embodiment, the step of performing a flushing treatment and the step of preparing a master batch can be omitted, and therefore, the decrease in the chargeability and color reproducibility of the toner particles and the deterioration of the high-temperature offset of the toner particles caused by performing these steps can be prevented. Moreover, by omitting these steps, the productivity of the toner is improved, and the production cost of the toner is also reduced.

The toner particles produced as described above may be directly used as the toner, or may be mixed with an external additive as needed, and then used as the toner.

The external additive will be described.

The external additive is added for improving the fluidity, chargeability, and stability during storage of the toner. Examples of the external additive include particles composed of an inorganic oxide. Examples of the inorganic oxide include silica, titania, alumina, strontium titanate, and tin oxide. Further, the particles composed of an inorganic oxide may be surface-treated with a hydrophobizing agent from the viewpoint of improvement of the stability.

The volume average particle diameter of a particle group of the particles composed of an inorganic oxide is not particularly limited, but is preferably in the range of 8 to 200 nm. If the volume average particle diameter of a particle group of the particles is less than the above lower limit, the transfer efficiency of the toner to a transfer belt or paper may be deteriorated. If the volume average particle diameter of a particle group of the particles exceeds the above upper limit, a photoconductor may be damaged or the like.

As the external additive, any one external additive may be used alone, or two or more external additives may be used in combination.

The addition amount of the external additive is not particularly limited, but is preferably in the range of 0.2 to 8.0% by mass of the total mass of the toner. To the toner, in addition to the particles composed of an inorganic oxide, resin fine particles having a size of 1 μm or less may be further added.

A method for adding the external additive will be described.

The external additive is mixed with the toner particles by, for example, a mixing machine. As the mixing machine, the same mixing machines as used in the method for producing the toner particles can be exemplified.

The external additive may be sieved by a sieving device for separating coarse particles and the like as needed. As the sieving device, an Ultra Sonic (manufactured by Koei Sangyo Co., Ltd.); a Resona sieve and a Gyro sifter (both of which are manufactured by Tokuju Corporation); a Vibrasonic system (manufactured by Dalton Co., Ltd.); a Soniclean (manufactured by Shinto Kogyo Kabushiki Kaisha); a Turbo screener (manufactured by Turbo Kogyo Co., Ltd.); a Micro sifter (manufactured by Makino Mfg. Co., Ltd.); a circular vibrating sieve; and the like can be exemplified.

The toner according to the embodiment is used as a one-component developer or a two-component developer in combination with a carrier.

A developer containing the toner according to the embodiment is not particularly limited, but is used in an image forming apparatus shown in FIG. 1. An image forming apparatus shown in FIG. 1 is configured to fix a toner image, but is not limited to this configuration, and may be configured to be of an inkjet type.

An image forming apparatus 1 shown in FIG. 1 is a color copying machine MFP (e-studio 4520c) of a four-series tandem system and includes a scanner section 2 in an upper part and also includes a paper discharge section 3.

The image forming apparatus 1 includes image forming stations 11Y, 11M, 11C, and 11K for the following four colors: yellow (Y), magenta (M), cyan (C), and black (K), which are arranged in parallel along the lower side of an intermediate transfer belt (intermediate transfer medium) 10.

The image forming stations 11Y, 11M, 11C, and 11K include photoconductive drums (image carrying bodies) 12Y, 12M, 12C, and 12K, respectively. Around the photoconductive drums 12Y, 12M, 12C, and 12K, electrifying chargers 13Y, 13M, 13C, and 13K, developing devices 14Y, 14M, 14C, and 14K, and photoconductor cleaning devices 16Y, 16M, 16C, and 16K are arranged along the rotating direction in the arrow S direction. An area between each of the electrifying chargers 13Y, 13M, 13C, and 13K and each of the developing devices 14Y, 14M, 14C, and 14K around each of the photoconductive drums 12Y, 12M, 12C, and 12K is irradiated with an exposure light from a laser exposing device (latent image forming device) 17 to form an electrostatic latent image on each of the photoconductive drums 12Y, 12M, 12C, and 12K.

The developing devices 14Y, 14M, 14C, and 14K each contain a two-component developer composed of a carrier and each of the toners of the respective colors of yellow (Y), magenta (N), cyan (C), and black (K) and supply the toner to the electrostatic latent images on the photoconductive drums 12Y, 12M, 12C, and 12K, respectively.

To the intermediate transfer belt 10, an arbitrary tension is applied by a backup roller 21, a driven roller 20, and first to third tension rollers 22 to 24. The intermediate transfer belt 10 faces and is in contact with the photoconductive drums 12Y, 12M, 12C, and 12K. Primary transfer rollers 18Y, 18M, 18C, and 18K for primarily transferring a toner image on each of the photoconductive drums 12Y, 12M, 12C, and 12K onto the intermediate transfer belt 10 are provided at positions where the intermediate transfer belt 10 faces the photoconductive drums 12Y, 12M, 12C, and 12K, respectively. These primary transfer rollers 18Y, 18M, 18C, and 18K are each a conductive roller, and a primary transfer bias voltage is applied to each of these primary transfer sections.

A secondary transfer roller 27 is disposed in a secondary transfer section which is a transfer position where the intermediate transfer belt 10 is supported by the backup roller 21. In the secondary transfer section, the backup roller 21 is a conductive roller, and a predetermined secondary transfer bias is applied. When a sheet paper (final transfer medium) to be printed passes between the intermediate transfer belt 10 and the secondary transfer roller 27, the toner image on the intermediate transfer belt 10 is secondarily transferred onto the sheet paper. After the secondary transfer is completed, the intermediate transfer belt 10 is cleaned by a belt cleaner 10*a*.

A paper feed cassette 4 for supplying a sheet paper P1 in the direction of the secondary transfer roller 27 is provided below the laser exposing device 17. A manual feed mechanism 31 for manually feeding a sheet paper P2 is provided on the right side of the image forming apparatus 1.

A pickup roller 4*a*, a separation roller 28*a*, a conveying roller 28*b*, and a resist roller pair 36 are provided between the paper feed cassette 4 and the secondary transfer roller 27, and a paper feed mechanism is constituted by these members. Further, a manual feed pickup roller 31*b* and a manual feed separation roller 31*c* are provided between a manual feed tray 31*a* of the manual feed mechanism 31 and the resist roller pair 36.

Further, a media sensor 39 for detecting the type of sheet paper is disposed on a longitudinal conveying path 35 for conveying the sheet paper in the direction of the secondary transfer roller 27 from the paper feed cassette 4 or the manual feed tray 31*a*. The image forming apparatus 1 is configured such that the conveying speed of the sheet paper, the transfer conditions, the fixing conditions, and the like can be controlled based on the detection result by the media sensor 39. Further, a fixing device 30 is provided downstream of the secondary transfer section along the direction of the longitudinal conveying path 35.

The sheet paper taken out from the paper feed cassette 4 or fed from the manual feed mechanism 31 is conveyed to the fixing device 30 through the resist roller pair 36 and the secondary transfer roller 27 along the longitudinal conveying path 35. The fixing device 30 includes a fixing belt 53 wound around a set of a heating roller 51 and a driving roller 52, and a counter roller 54 disposed to face the heating roller 51 through the fixing belt 53. The sheet paper having the toner image transferred thereon in the secondary transfer section is introduced between the fixing belt 53 and the counter roller 54, and is heated by the heating roller 51, whereby the toner image transferred onto the sheet paper is fixed by a heat treatment.

The toner according to the embodiment has excellent low-temperature fixability and can be fixed at, for example, about 125° C. or lower. Further, the toner according to the embodiment has excellent color reproducibility, and for example, an image obtained when the image is formed on paper at a deposition amount of 0.40 mg/cm$^2$ has an L* value in the range of 47 to 60, an a* value in the range of 70 or more, and a b* value in the range of −5 to 13 in the L*a*b* color system. When the L* value, the a* value, and the b* value are within the above ranges, the color developability is enhanced with a single magenta color, and further, the developability of red color obtained by superposition of yellow and the developability of blue color obtained by superposition of cyan are enhanced, and the balance of the developability of these colors also becomes favorable.

The L* value, the a* value, and the b* value in the L*a*b* color system are measured using, for example, X-Rite 939 (manufactured by X-Rite, Inc.). The measurement conditions are, for example, as follows: a light source: D50, a viewing angle: 2-degree view field, a geometric optics condition for a measuring instrument: 45/0 (illumination angle/acceptance angle), and measurement is performed by stacking 10 sheets of paper used.

A gate 33 is provided downstream of the fixing device 30, and the sheet paper is distributed in the direction of a paper discharge roller 41 or in the direction of a reconveying unit 32. The sheet paper guided to the paper discharge roller 41 is discharged to a paper discharge section 3. Further, the sheet paper guided to the reconveying unit 32 is guided again in the direction of the secondary transfer roller 27. The image forming station 11Y integrally includes the photoconductive drum 12Y and a process member and is provided detachably with respect to the main body of the image forming apparatus. As the process member, at least one of the electrifying charger 13Y, the developing device 14Y, and the photoconductor cleaning device 16Y can be exemplified. The image forming stations 11M, 11C, and 11K have the same structure as that of the image forming station 11Y. The image forming stations 11Y, 11M, 11C, and 11K may be detachable with respect to the image forming apparatus independently, or may be detachable with respect to the image forming apparatus as an integrated image forming unit 11.

The color copying machine as described above is a high-speed machine and a toner to be used therein is required to have a long life property. The toner according to the embodiment is prevented from depositing the coloring agent on the surfaces of the toner particles and enhances the charging stability, and therefore, realizes a high-quality image over a long period of time.

Hereinafter, embodiments will be more specifically described with reference to Examples.

Ester waxes A to H were prepared as follows.

A preparation example of the ester wax will be described.

In a four-necked flask equipped with a stirrer, a thermocouple, and a nitrogen inlet tube, 80 parts by mass of a long-chain alkyl carboxylic acid component and 20 parts by mass of a long-chain alkyl alcohol component were placed. Then, an esterification reaction was performed at 220° C. in a nitrogen stream, whereby a reaction product was obtained.

Thereafter, to the flask, a mixed solvent of toluene and ethanol was added to dissolve the reaction product. Further, to the flask, an aqueous solution of sodium hydroxide was added, and the mixture was stirred at 70° C. for 30 minutes. Thereafter, the flask was left to stand for 30 minutes to separate the contents of the flask into an organic layer and an aqueous layer, and then, the aqueous layer was removed from the contents.

Thereafter, ion exchanged water was added to the flask, and the mixture was stirred at 70° C. for 30 minutes. Thereafter, the flask was left to stand for 30 minutes to separate the contents in the flask into an aqueous layer and an organic layer, and then, the aqueous layer was removed from the contents. This procedure was repeated 5 times. The solvent was distilled off from the organic layer of the contents in the flask under a reduced pressure condition, whereby an ester wax was obtained.

By adjusting the types and blending ratios of the following long-chain alkyl carboxylic acid components and the following long-chain alkyl alcohol components, ester waxes A to H composed of ester compounds having different carbon number distributions were prepared.

The long-chain alkyl carboxylic acid components are as follows.

palmitic acid ($C_{16}H_{32}O_2$)
stearic acid ($C_{18}H_{36}O_2$)
arachidonic acid ($C_{20}H_{40}O_2$)
behenic acid ($C_{22}H_{44}O_2$)
lignoceric acid ($C_{24}H_{48}O_2$)
cerotic acid ($C_{26}H_{52}O_2$)
montanoic acid ($C_{28}H_{56}O_2$)

The long-chain alkyl alcohol components are as follows.

palmityl alcohol ($C_{16}H_{34}O$)
stearyl alcohol ($C_{18}H_{38}O$)
arachidyl alcohol ($C_{28}H_{42}O$)
behenyl alcohol ($C_{22}H_{46}O$)
lignoceryl alcohol ($C_{24}H_{50}O$)
ceryl alcohol ($C_{26}H_{54}O$)
montanyl alcohol ($C_{28}H_{58}O$)

The ester waxes A to D are configured as follows: the content of an ester compound having a carbon number of ($C_n$) whose content in the ester wax is the highest is in the range of 20 to 58% by mass of the total mass of the ester wax; the content of ester compounds having a carbon number of 38 or less in the ester wax is 10% by mass or less of the total mass of the ester wax; and the ratio (d/a) of the total content d of an ester compound having a carbon number of ($C_n$−4) and an ester compound having a carbon number of ($C_n$−2) in the ester wax to the content a of the ester compound having a carbon number of ($C_n$) in the ester wax is in the range of 0.619 to 0.783.

On the other hand, the ester wax E was prepared such that the content of an ester compound having a carbon number of ($C_n$) exceeds 58% by mass of the total mass of the wax by increasing the blending ratios of behenic acid and behenyl alcohol in the long-chain alkyl carboxylic acid components and the long-chain alkyl alcohol components, and the like. The ester wax F was prepared such that the content of an ester compound having a carbon number of ($C_n$) is less than 20% by mass of the total mass of the wax by increasing the blending ratios of stearic acid and stearyl alcohol in the long-chain alkyl carboxylic acid components and the long-chain alkyl alcohol components, and the like. The ester wax G was prepared such that the d/a ratio is less than 0.619 by increasing the blending ratios of behenic acid and behenyl alcohol in the long-chain alkyl carboxylic acid components and the long-chain alkyl alcohol components, and the like. The ester wax H was prepared such that the d/a ratio exceeds 0.783 by decreasing the blending ratios of stearic acid and stearyl alcohol in the long-chain alkyl carboxylic acid components and the long-chain alkyl alcohol components, and the like.

The carbon number distribution of ester compounds (the content ratios of ester compounds having different carbon numbers) constituting each of the obtained ester waxes A to H, melting point, acid value, and hydroxyl value were measured as follows. The measurement results are shown in FIG. 2.

A measurement method for the carbon number distribution of ester compounds (the content ratios of ester compounds having different carbon numbers) constituting each ester wax will be described.

The carbon number distribution of ester compounds (the content ratios of ester compounds having different carbon numbers) constituting each ester wax was measured using FD-MS (JMS-T100GC, manufactured by JEOL Ltd.). The measurement conditions are as follows.

Sample concentration: 1 mg/mL (solvent: chloroform)

Cathode voltage: −10 kV

Spectrum recording interval: 0.4 s

Measurement mass range (m/z): 10 to 2000

The total ion intensity of ester compounds having different carbon numbers obtained by the measurement is determined to be 100. The relative values of the ion intensities of the ester compounds having different carbon numbers with respect to the total ion intensity are calculated. The relative values are defined as the content ratios of the ester compounds having different carbon numbers in the ester wax. Further, the carbon number of an ester compound having a carbon number showing the highest relative value is defined as C.

A measurement method for the melting point will be described.

The melting point was measured using DSC (DSC Q2000, manufactured by TA Instruments, Inc.). The measurement conditions are as follows.

Sample amount: 5 mg

Lid and pan: made of alumina

Temperature raising rate: 10° C./min

Measurement method: A sample is heated from 20° C. to 200° C. Thereafter, the sample is cooled to 20° C. or lower. Then, the sample is heated again, and the maximum endothermic peak measured in the temperature range from 55 to 80° C. is defined as the melting point.

A measurement method for the acid value and the hydroxyl value will be described.

The acid value and the hydroxyl value were measured according to JIS K 0070.

Toners of Examples 1 to 28 and Comparative Examples 1 to 8 will be described.

By using the above ester waxes A to H, the toners of Examples 1 to 28 and Comparative Examples 1 to 8 were produced as follows.

Example 1

The following toner particle starting materials were placed and mixed in a Henschel mixer. The resulting mixture was melt-kneaded by a twin-screw extruder. The melt-kneaded material was cooled and then coarsely pulverized by a hammer mill. The coarsely pulverized material was finely pulverized by a jet pulverizer. The finely pulverized material was classified, whereby toner particles were obtained. The toner particles had a volume average diameter of 7 μm and a glass transition temperature (Tg) of 33.4° C.

The composition of the toner particle starting materials is as follows.

Amorphous polyester resin: 79.8 parts by mass

Crystalline polyester resin (endothermic peak temperature: 90° C.): 5 parts by mass Ester wax A: 7 parts by mass Coloring agent X1 (C.I. Pigment Red 48:3, manufactured by Dainichiseika Color & Chemicals Mfg. Co., Ltd.): 3.75 parts by mass Coloring agent Y (C.I. Pigment Red 122, manufactured by Dainichiseika Color & Chemicals Mfg. Co., Ltd.): 3.75 parts by mass Charge control agent (a clathrate compound of a polysaccharide containing aluminum and magnesium): 0.7 parts by mass 100 parts by mass of the above toner particles and the following external additives were placed and mixed in a Henschel mixer, whereby a toner of Example 1 was produced.

The composition of the external additives is as follows.

Hydrophobic silica A (trade name "RX50", manufactured by Nippon AEROSIL Co., Ltd., average primary particle diameter: 35 nm): 0.8 parts by mass Hydrophobic silica B (trade name "VP SX110", manufactured by Nippon AEROSIL Co., Ltd., average primary particle diameter: 100 nm): 0.7 parts by mass Hydrophobic titanium oxide (trade name "STT-30S", manufactured by Titan Kogyo, Ltd., average primary particle diameter: 20 nm): 0.5 parts by mass

Example 2

A toner of Example 2 was produced in the same manner as in Example 1 except that the following toner particle starting materials and external additives were used. Incidentally, the toner particles had a volume average diameter of 7 μm and a Tg of 35.4° C.

The composition of the toner particle starting materials is as follows.

Amorphous polyester resin: 76.5 parts by mass

Crystalline polyester resin (endothermic peak temperature: 100° C.): 10 parts by mass Ester wax A: 5 parts by mass Coloring agent X1: 2.25 parts by mass Coloring agent Y: 5.25 parts by mass Charge control agent: 1 part by mass The composition of the external additives is as follows.

Hydrophobic silica A: 1 part by mass

Hydrophobic silica B: 0.6 parts by mass

Hydrophobic titanium oxide: 0.6 parts by mass

Example 3

A toner of Example 3 was produced in the same manner as in Example 1 except that the following toner particle starting materials and external additives were used. Incidentally, the toner particles had a volume average diameter of 7 μm and a Tg of 33.9° C.

The composition of the toner particle starting materials is as follows.

Amorphous polyester resin: 74.8 parts by mass

Crystalline polyester resin (endothermic peak temperature: 105° C.): 10 parts by mass Ester wax A: 7 parts by mass Coloring agent X1: 4.5 parts by mass Coloring agent Y: 3 parts by mass Charge control agent: 0.7 parts by mass The composition of the external additives is as follows.

Hydrophobic silica A: 0.8 parts by mass

Hydrophobic silica B: 0.8 parts by mass

Hydrophobic titanium oxide: 0.5 parts by mass

Example 4

A toner of Example 4 was produced in the same manner as in Example 1 except that the following toner particle starting materials and external additives were used. Incidentally, the toner particles had a volume average diameter of 7 μm and a Tg of 33.2° C.

The composition of the toner particle starting materials is as follows.

Amorphous polyester resin: 43.3 parts by mass

Crystalline polyester resin (endothermic peak temperature: 90° C.): 32 parts by mass Ester wax A: 12 parts by mass Coloring agent X1: 3.6 parts by mass Coloring agent Y: 8.4 parts by mass Charge control agent: 0.7 parts by mass The composition of the external additives is as follows.

Hydrophobic silica A: 1.2 parts by mass

Hydrophobic silica B: 0.8 parts by mass

Hydrophobic titanium oxide: 0.6 parts by mass

Example 5

A toner of Example 5 was produced in the same manner as in Example 1 except that the following toner particle starting materials and external additives were used. Incidentally, the toner particles had a volume average diameter of 7 μm and a Tg of 33.7° C.

The composition of the toner particle starting materials is as follows.

Amorphous polyester resin: 78 parts by mass

Crystalline polyester resin (endothermic peak temperature: 100° C.): 10 parts by mass Ester wax A: 7 parts by mass Coloring agent X1: 1.2 parts by mass Coloring agent Y: 2.8 parts by mass Charge control agent: 1 part by mass The composition of the external additives is as follows.

Hydrophobic silica A: 1.2 parts by mass

Hydrophobic silica B: 0.6 parts by mass

Hydrophobic titanium oxide: 0.5 parts by mass

Example 6

A toner of Example 6 was produced in the same manner as in Example 1 except that the following toner particle starting materials and external additives were used. Incidentally, the toner particles had a volume average diameter of 7 μm and a Tg of 34.7° C.

The composition of the toner particle starting materials is as follows.

Amorphous polyester resin: 77 parts by mass

Crystalline polyester resin (endothermic peak temperature: 105° C.): 5 parts by mass Ester wax A: 5 parts by mass Coloring agent X1: 7.2 parts by mass Coloring agent Y: 4.8 parts by mass Charge control agent: 1 part by mass The composition of the external additives is as follows.

Hydrophobic silica A: 0.8 parts by mass

Hydrophobic silica B: 0.7 parts by mass

Hydrophobic titanium oxide: 0.5 parts by mass

Example 7

A toner of Example 7 was produced in the same manner as in Example 1 except that the following toner particle starting materials and external additives were used. Incidentally, the toner particles had a volume average diameter of 7 μm and a Tg of 33.9° C.

The composition of the toner particle starting materials is as follows.

Amorphous polyester resin: 70.3 parts by mass

Crystalline polyester resin (endothermic peak temperature: 105° C.): 15 parts by mass Ester wax A: 10 parts by mass Coloring agent X1: 2.4 parts by mass Coloring agent Y: 1.6 parts by mass Charge control agent: 0.7 parts by mass The composition of the external additives is as follows.

Hydrophobic silica A: 0.8 parts by mass

Hydrophobic silica B: 0.7 parts by mass

Hydrophobic titanium oxide: 0.5 parts by mass

Example 8

A toner of Example 8 was produced in the same manner as in Example 1 except that the following toner particle starting materials and external additives were used. Incidentally, the toner particles had a volume average diameter of 7 μm and a Tg of 36.7° C.

The composition of the toner particle starting materials is as follows.

Amorphous polyester resin: 74.3 parts by mass

Crystalline polyester resin (endothermic peak temperature: 100° C.): 10 parts by mass Ester wax B: 7 parts by mass Coloring agent X1: 3.75 parts by mass Coloring agent Y: 3.75 parts by mass Charge control agent: 1.2 parts by mass The composition of the external additives is as follows.

Hydrophobic silica A: 1 part by mass

Hydrophobic silica B: 0.8 parts by mass

Hydrophobic titanium oxide: 0.5 parts by mass

Example 9

A toner of Example 9 was produced in the same manner as in Example 1 except that the following toner particle starting materials and external additives were used. Incidentally, the toner particles had a volume average particle diameter of 7 μm and a Tg of 35.8° C.

The composition of the toner particle starting materials is as follows.

Amorphous polyester resin: 81.3 parts by mass

Crystalline polyester resin (endothermic peak temperature: 105° C.): 5 parts by mass Ester wax B: 5 parts by mass Coloring agent X1: 2.25 parts by mass Coloring agent Y: 5.25 parts by mass Charge control agent: 1.2 parts by mass The composition of the external additives is as follows.

Hydrophobic silica A: 1.2 parts by mass

Hydrophobic silica B: 0.9 parts by mass

Hydrophobic titanium oxide: 0.5 parts by mass

Example 10

A toner of Example 10 was produced in the same manner as in Example 1 except that the following toner particle starting materials and external additives were used. Incidentally, the toner particles had a volume average diameter of 7 μm and a Tg of 37.1° C.

The composition of the toner particle starting materials is as follows.

Amorphous polyester resin: 71.8 parts by mass

Crystalline polyester resin (endothermic peak temperature: 105° C.): 10 parts by mass Ester wax B: 10 parts by mass Coloring agent X1: 4.5 parts by mass Coloring agent Y: 3 parts by mass Charge control agent: 0.7 parts by mass The composition of the external additives is as follows.

Hydrophobic silica A: 0.8 part by mass

Hydrophobic silica B: 0.6 parts by mass

Hydrophobic titanium oxide: 0.4 parts by mass

Example 11

A toner of Example 11 was produced in the same manner as in Example 1 except that the following toner particle starting materials and external additives were used. Incidentally, the toner particles had a volume average particle diameter of 7 μm and a Tg of 36.1° C.

The composition of the toner particle starting materials is as follows.

Amorphous polyester resin: 71.5 parts by mass

Crystalline polyester resin (endothermic peak temperature: 100° C.): 10 parts by mass Ester wax B: 10 parts by mass Coloring agent X1: 3 parts by mass Coloring agent Y: 4.5 parts by mass Charge control agent: 1 part by mass The composition of the external additives is as follows.

Hydrophobic silica A: 1 part by mass

Hydrophobic silica B: 0.7 parts by mass

Hydrophobic titanium oxide: 0.6 parts by mass

Example 12

A toner of Example 12 was produced in the same manner as in Example 1 except that the following toner particle starting materials and external additives were used. Incidentally, the toner particles had a volume average diameter of 7 μm and a Tg of 36.8° C.

The composition of the toner particle starting materials is as follows.

Amorphous polyester resin: 69.5 parts by mass

Crystalline polyester resin (endothermic peak temperature: 105° C.): 15 parts by mass Ester wax B: 7 parts by mass Coloring agent X1: 3 parts by mass Coloring agent Y: 4.125 parts by mass Charge control agent: 3.375 part by mass The composition of the external additives is as follows.

Hydrophobic silica A: 1 part by mass

Hydrophobic silica B: 0.8 parts by mass

Hydrophobic titanium oxide: 0.4 parts by mass

Example 13

A toner of Example 13 was produced in the same manner as in Example 1 except that the following toner particle starting materials and external additives were used. Incidentally, the toner particles had a volume average diameter of 7 μm and a Tg of 34.5° C.

The composition of the toner particle starting materials is as follows.

Amorphous polyester resin: 79.8 parts by mass

Crystalline polyester resin (endothermic peak temperature: 90° C.): 5 parts by mass Ester wax C: 7 parts by mass Coloring agent X1: 3.75 parts by mass Coloring agent Y: 3.75 parts by mass Charge control agent: 0.7 parts by mass The composition of the external additives is as follows.

Hydrophobic silica A: 0.8 parts by mass

Hydrophobic silica B: 0.6 parts by mass

Hydrophobic titanium oxide: 0.5 parts by mass

Example 14

A toner of Example 14 was produced in the same manner as in Example 1 except that the following toner particle starting materials and external additives were used. Incidentally, the toner particles had a volume average diameter of 7 μm and a Tg of 33.6° C.

The composition of the toner particle starting materials is as follows.

Amorphous polyester resin: 76.5 parts by mass

Crystalline polyester resin (endothermic peak temperature: 100° C.): 10 parts by mass Ester wax C: 7 parts by mass Coloring agent X1: 2.25 parts by mass Coloring agent Y: 5.25 parts by mass Charge control agent: 1 part by mass The composition of the external additives is as follows.

Hydrophobic silica A: 1 part by mass

Hydrophobic silica B: 0.7 parts by mass

Hydrophobic titanium oxide: 0.6 parts by mass

Example 15

A toner of Example 15 was produced in the same manner as in Example 1 except that the following toner particle starting materials and external additives were used. Incidentally, the toner particles had a volume average diameter of 7 μm and a Tg of 34.9° C.

The composition of the toner particle starting materials is as follows.

Amorphous polyester resin: 74.8 parts by mass

Crystalline polyester resin (endothermic peak temperature: 110° C.): 10 parts by mass Ester wax C: 7 parts by mass Coloring agent X1: 4.5 parts by mass Coloring agent Y: 3 parts by mass Charge control agent: 0.7 parts by mass The composition of the external additives is as follows.

Hydrophobic silica A: 0.8 parts by mass

Hydrophobic silica B: 0.6 parts by mass

Hydrophobic titanium oxide: 0.7 parts by mass

Example 16

A toner of Example 16 was produced in the same manner as in Example 1 except that the following toner particle starting materials and external additives were used. Incidentally, the toner particles had a volume average diameter of 7 μm and a Tg of 34.4° C.

The composition of the toner particle starting materials is as follows.

Amorphous polyester resin: 64.3 parts by mass

Crystalline polyester resin (endothermic peak temperature: 105° C.): 10 parts by mass Ester wax C: 13 parts by mass Coloring agent X1: 3.6 parts by mass Coloring agent Y: 8.4 parts by mass Charge control agent: 0.7 parts by mass The composition of the external additives is as follows.

Hydrophobic silica A: 0.8 parts by mass

Hydrophobic silica B: 0.6 parts by mass

Hydrophobic titanium oxide: 0.4 parts by mass

Example 17

A toner of Example 17 was produced in the same manner as in Example 1 except that the following toner particle starting materials and external additives were used. Incidentally, the toner particles had a volume average diameter of 7 μm and a Tg of 33.9° C.

The composition of the toner particle starting materials is as follows.

Amorphous polyester resin: 85 parts by mass

Crystalline polyester resin (endothermic peak temperature: 90° C.): 5 parts by mass Ester wax C: 5 parts by mass Coloring agent X1: 1.2 parts by mass Coloring agent Y: 2.8 parts by mass Charge control agent: 1 part by mass The composition of the external additives is as follows.

Hydrophobic silica A: 1 part by mass

Hydrophobic silica B: 0.8 parts by mass

Hydrophobic titanium oxide: 0.6 parts by mass

Example 18

A toner of Example 18 was produced in the same manner as in Example 1 except that the following toner particle starting materials and external additives were used. Incidentally, the toner particles had a volume average diameter of 7 μm and a Tg of 34.0° C.

The composition of the toner particle starting materials is as follows.

Amorphous polyester resin: 71 parts by mass

Crystalline polyester resin (endothermic peak temperature: 105° C.): 10 parts by mass Ester wax C: 7 parts by mass Coloring agent X1: 3.3 parts by mass Coloring agent Y: 7.7 parts by mass Charge control agent: 1 part by mass The composition of the external additives is as follows.

Hydrophobic silica A: 1 part by mass

Hydrophobic silica B: 0.8 parts by mass

Hydrophobic titanium oxide: 0.4 parts by mass

Example 19

A toner of Example 19 was produced in the same manner as in Example 1 except that the following toner particle starting materials and external additives were used. Incidentally, the toner particles had a volume average diameter of 7 μm and a Tg of 33.8° C.

The composition of the toner particle starting materials is as follows.

Amorphous polyester resin: 77 parts by mass

Crystalline polyester resin (endothermic peak temperature: 100° C.): 10 parts by mass Ester wax C: 7 parts by mass Coloring agent X1: 1.5 parts by mass Coloring agent Y: 3.5 parts by mass Charge control agent: 1 part by mass The composition of the external additives is as follows.

Hydrophobic silica A: 1.2 parts by mass

Hydrophobic silica B: 0.9 parts by mass

Hydrophobic titanium oxide: 0.5 parts by mass

Example 20

A toner of Example 20 was produced in the same manner as in Example 1 except that the following toner particle starting materials and external additives were used. Incidentally, the toner particles had a volume average diameter of 7 μm and a Tg of 33.9° C.

The composition of the toner particle starting materials is as follows.

Amorphous polyester resin: 78 parts by mass

Crystalline polyester resin (endothermic peak temperature: 90° C.): 10 parts by mass Ester wax C: 5 parts by mass Coloring agent X1: 1.8 parts by mass Coloring agent Y: 4.2 parts by mass Charge control agent: 1 part by mass The composition of the external additives is as follows.

Hydrophobic silica A: 1 part by mass

Hydrophobic silica B: 0.8 parts by mass

Hydrophobic titanium oxide: 0.6 parts by mass

Example 21

A toner of Example 21 was produced in the same manner as in Example 1 except that the following toner particle starting materials and external additives were used. Incidentally, the toner particles had a volume average diameter of 7 μm and a Tg of 35.1° C.

The composition of the toner particle starting materials is as follows.

Amorphous polyester resin: 67.3 parts by mass

Crystalline polyester resin (endothermic peak temperature: 105° C.): 10 parts by mass Ester wax C: 10 parts by mass Coloring agent X1: 7.2 parts by mass Coloring agent Y: 4.8 parts by mass Charge control agent: 0.7 parts by mass The composition of the external additives is as follows.

Hydrophobic silica A: 0.8 parts by mass

Hydrophobic silica B: 0.6 parts by mass

Hydrophobic titanium oxide: 0.4 parts by mass

Example 22

A toner of Example 22 was produced in the same manner as in Example 1 except that the following toner particle starting materials and external additives were used. Incidentally, the toner particles had a volume average diameter of 7 μm and a Tg of 34.8° C.

The composition of the toner particle starting materials is as follows.

Amorphous polyester resin: 85 parts by mass

Crystalline polyester resin (endothermic peak temperature: 78° C.): 5 parts by mass Ester wax C: 5 parts by mass Coloring agent X1: 2.4 parts by mass Coloring agent Y: 1.6 parts by mass Charge control agent: 1 part by mass The composition of the external additives is as follows.

Hydrophobic silica A: 1 part by mass

Hydrophobic silica B: 0.8 parts by mass

Hydrophobic titanium oxide: 0.6 parts by mass

Example 23

A toner of Example 23 was produced in the same manner as in Example 1 except that the following toner particle starting materials and external additives were used. Incidentally, the toner particles had a volume average diameter of 7 μm and a Tg of 35.1° C.

The composition of the toner particle starting materials is as follows.

Amorphous polyester resin: 71 parts by mass

Crystalline polyester resin (endothermic peak temperature: 100° C.): 10 parts by mass Ester wax C: 7 parts by mass Coloring agent X1: 6.6 parts by mass Coloring agent Y: 4.4 parts by mass Charge control agent: 1 part by mass The composition of the external additives is as follows.

Hydrophobic silica A: 1 part by mass

Hydrophobic silica B: 0.8 parts by mass

Hydrophobic titanium oxide: 0.4 parts by mass

Example 24

A toner of Example 24 was produced in the same manner as in Example 1 except that the following toner particle starting materials and external additives were used. Incidentally, the toner particles had a volume average diameter of 7 μm and a Tg of 34.9° C.

The composition of the toner particle starting materials is as follows.

Amorphous polyester resin: 77 parts by mass

Crystalline polyester resin (endothermic peak temperature: 100° C.): 10 parts by mass Ester wax C: 7 parts by mass Coloring agent X1: 3 parts by mass Coloring agent Y: 2 parts by mass Charge control agent: 1 part by mass The composition of the external additives is as follows.

Hydrophobic silica A: 1.2 parts by mass

Hydrophobic silica B: 0.8 parts by mass

Hydrophobic titanium oxide: 0.5 parts by mass

Example 25

A toner of Example 25 was produced in the same manner as in Example 1 except that the following toner particle starting materials and external additives were used. Incidentally, the toner particles had a volume average diameter of 7 μm and a Tg of 34.8° C.

The composition of the toner particle starting materials is as follows.

Amorphous polyester resin: 81 parts by mass

Crystalline polyester resin (endothermic peak temperature: 90° C.): 5 parts by mass Ester wax C: 7 parts by mass Coloring agent X1: 3.6 parts by mass Coloring agent Y: 2.4 parts by mass Charge control agent: 1 part by mass The composition of the external additives is as follows.

Hydrophobic silica A: 1 part by mass

Hydrophobic silica B: 0.8 parts by mass

Hydrophobic titanium oxide: 0.6 parts by mass

Example 26

A toner of Example 26 was produced in the same manner as in Example 1 except that the following toner particle starting materials and external additives were used. Incidentally, the toner particles had a volume average diameter of 7 μm and a Tg of 36.3° C.

The composition of the toner particle starting materials is as follows.

Amorphous polyester resin: 76.5 parts by mass

Crystalline polyester resin (endothermic peak temperature: 95° C.): 5 parts by mass Ester wax B: 10 parts by mass Coloring agent X2 (C.I. Pigment Red 48:2 manufactured by Dainichiseika Color & Chemicals Mfg. Co., Ltd.): 4.5 parts by mass Coloring agent Y: 3 parts by mass Charge control agent: 1 part by mass The composition of the external additives is as follows.

Hydrophobic silica A: 1 part by mass

Hydrophobic silica B: 0.8 parts by mass

Hydrophobic titanium oxide: 0.6 parts by mass

Example 27

The following toner particle starting materials were placed and mixed in a Henschel mixer.

The composition of the toner particle starting materials is as follows.

Amorphous polyester resin: 76.5 parts by mass

Crystalline polyester resin (endothermic peak temperature: 100° C.): 10 parts by mass Ester wax B: 5 parts by mass Coloring agent X1: 3.75 parts by mass Coloring agent Y: 3.75 parts by mass Charge control agent: 1 part by mass The resulting mixture was melt-kneaded by a twin-screw extruder. The kneaded material was cooled and then coarsely pulverized by a hammer mill. The coarsely pulverized material was further pulverized by a pulverizer (manufactured by Hosokawa Micron Corporation), whereby moderately pulverized particles having a volume average particle diameter of 59 μm were obtained.

30 parts by mass of the moderately pulverized particles, 1 part by mass of an anionic surfactant (sodium dodecylbenzenesulfonate), 1 part by mass of triethylamine, and 68 parts by mass of ion exchanged water were placed and stirred in a homogenizer (manufactured by IKA Corporation), whereby a mixed liquid was obtained.

The obtained mixed liquid was placed in a Nanomizer (YSNM-2000AR, manufactured by Yoshida Kikai Co., Ltd.) and processed repeatedly three times at 120° C. at a processing pressure of 150 MPa, whereby a fine particle dispersion liquid was obtained. The volume average particle diameter of the fine particles in the fine particle dispersion liquid was 0.7 μm (measured by SALD-7000 manufactured by Shimadzu Corporation) and the pH of the fine particle dispersion liquid was 8.3.

The fine particle dispersion liquid was diluted such that the solid content concentration was 18% by mass. While maintaining the temperature of the diluted liquid at 30° C., 0.1 M hydrochloric acid was added dropwise to the diluted liquid until the pH reached 7.0. The volume average particle diameter of the fine particles in the diluted liquid was 0.84 μm. Further, 0.1 M hydrochloric acid was added dropwise to the diluted liquid, and when the ζ potential of the fine particles reached −30 mV, the dropwise addition was completed. At this time, the pH was 3.8.

Subsequently, the temperature of the diluted liquid was raised to 80° C. at a rate of 10° C./min while stirring the diluted liquid with a paddle blade (at 500 rpm), and then the diluted liquid was maintained at 80° C. for one hour. After cooling, the diluted liquid was left to stand overnight. The supernatant in the diluted liquid after being left was transparent, and unaggregated particles were not observed. The volume average diameter of the particles in the diluted liquid was 6 μm, and particles having a volume average diameter of 20 μm or more were not observed. The diluted liquid was dried by a vacuum dryer until the water content was decreased to 0.8% by mass or less, whereby toner particles were obtained. The toner particles had a volume average diameter of 6 μm and a Tg of 36.0° C. 100 parts by mass of the above toner particles and the following external additives were placed and mixed in a Henschel mixer, whereby a toner of Example 27 was produced.

The composition of the external additives is as follows.

Hydrophobic silica A: 1.2 parts by mass

Hydrophobic silica B: 0.8 parts by mass

Hydrophobic titanium oxide: 0.4 parts by mass

Example 28

A toner of Example 28 was produced in the same manner as in Example 1 except that the following toner particle starting materials and external additives were used.

Incidentally, the toner particles had a volume average particle diameter of 7 μm and a Tg of 37.0° C.

The composition of the toner particle starting materials is as follows.

Amorphous polyester resin: 74.5 parts by mass

Crystalline polyester resin (endothermic peak temperature: 95° C.): 10 parts by mass Ester wax D: 7 parts by mass Coloring agent X1: 3.75 parts by mass Coloring agent Y: 3.75 parts by mass Charge control agent: 1 part by mass The composition of the external additives is as follows.

Hydrophobic silica A: 1 part by mass

Hydrophobic silica B: 0.9 parts by mass

Hydrophobic titanium oxide: 0.6 parts by mass

Comparative Example 1

A toner of Comparative Example 1 was produced in the same manner as in Example 1 except that the following toner particle starting materials and external additives were used. Incidentally, the toner particles had a volume average particle diameter of 7 μm and a Tg of 36.9° C.

The composition of the toner particle starting materials is as follows.

Amorphous polyester resin: 73.5 parts by mass

Crystalline polyester resin (endothermic peak temperature: 105° C.): 5 parts by mass Ester wax E: 10 parts by mass Coloring agent X1: 3.75 parts by mass Coloring agent Y: 3.75 parts by mass Charge control agent: 2 parts by mass The composition of the external additives is as follows.

Hydrophobic silica A: 1 part by mass

Hydrophobic silica B: 0.8 parts by mass

Hydrophobic titanium oxide: 0.7 parts by mass

Comparative Example 2

A toner of Comparative Example 2 was produced in the same manner as in Example 1 except that the following toner particle starting materials and external additives were used. Incidentally, the toner particles had a volume average particle diameter of 7 μm and a Tg of 33.7° C.

The composition of the toner particle starting materials is as follows.

Amorphous polyester resin: 78.5 parts by mass

Crystalline polyester resin (endothermic peak temperature: 110° C.): 5 parts by mass Ester wax F: 7 parts by mass Coloring agent X1: 3.75 parts by mass Coloring agent Y: 3.75 parts by mass Charge control agent: 2 parts by mass The composition of the external additives is as follows.

Hydrophobic silica A: 1 part by mass

Hydrophobic silica B: 0.9 parts by mass

Hydrophobic titanium oxide: 0.7 parts by mass

Comparative Example 3

A toner of Comparative Example 3 was produced in the same manner as in Example 1 except that the following toner particle starting materials and external additives were used. Incidentally, the toner particles had a volume average particle diameter of 7 μm and a Tg of 42.0° C.

The composition of the toner particle starting materials is as follows.

Amorphous polyester resin: 71.5 parts by mass

Crystalline polyester resin (endothermic peak temperature: 100° C.): 10 parts by mass Ester wax G: 10 parts by mass Coloring agent X1: 3.75 parts by mass Coloring agent Y: 3.75 parts by mass Charge control agent: 1 part by mass The composition of the external additives is as follows.

Hydrophobic silica A: 0.8 parts by mass

Hydrophobic silica B: 0.8 parts by mass

Hydrophobic titanium oxide: 0.5 parts by mass

Comparative Example 4

A toner of Comparative Example 4 was produced in the same manner as in Example 1 except that the following toner particle starting materials and external additives were used. Incidentally, the toner particles had a volume average particle diameter of 7 μm and a Tg of 35.5° C.

The composition of the toner particle starting materials is as follows.

Amorphous polyester resin: 76.3 parts by mass

Crystalline polyester resin (endothermic peak temperature: 90° C.): 5 parts by mass Ester wax H: 10 parts by mass Coloring agent X1: 3.75 parts by mass Coloring agent Y: 3.75 parts by mass Charge control agent: 1.2 parts by mass The composition of the external additives is as follows.

Hydrophobic silica A: 1.2 parts by mass

Hydrophobic silica B: 0.7 parts by mass

Hydrophobic titanium oxide: 0.6 parts by mass

Comparative Example 5

A toner of Comparative Example 5 was produced in the same manner as in Example 1 except that the following toner particle starting materials and external additives were used. Incidentally, the toner particles had a volume average particle diameter of 7 μm and a Tg of 34.9° C.

The composition of the toner particle starting materials is as follows.

Amorphous polyester resin: 75.3 parts by mass

Crystalline polyester resin (endothermic peak temperature: 105° C.): 15 parts by mass Ester wax B: 5 parts by mass Coloring agent X1: 0.8 parts by mass Coloring agent Y: 3.2 parts by mass Charge control agent: 0.7 parts by mass The composition of the external additives is as follows.

Hydrophobic silica A: 0.8 parts by mass

Hydrophobic silica B: 0.6 parts by mass

Hydrophobic titanium oxide: 0.7 parts by mass

Comparative Example 6

A toner of Comparative Example 6 was produced in the same manner as in Example 1 except that the following toner particle starting materials and external additives were used. Incidentally, the toner particles had a volume average particle diameter of 7 μm and a Tg of 35.9° C.

The composition of the toner particle starting materials is as follows.

Amorphous polyester resin: 74.5 parts by mass

Crystalline polyester resin (endothermic peak temperature: 90° C.): 10 parts by mass Ester wax B: 7 parts by mass Coloring agent X1: 1.5 parts by mass Coloring agent Y: 0.6 parts by mass Charge control agent: 1 part by mass The composition of the external additives is as follows.

Hydrophobic silica A: 1 part by mass

Hydrophobic silica B: 0.9 parts by mass

Hydrophobic titanium oxide: 0.5 parts by mass

Comparative Example 7

A toner of Comparative Example 7 was produced in the same manner as in Example 1 except that the following toner particle starting materials and external additives were used. Incidentally, the toner particles had a volume average particle diameter of 7 μm and a Tg of 36.5° C.

The composition of the toner particle starting materials is as follows.

Amorphous polyester resin: 74.3 parts by mass

Crystalline polyester resin (endothermic peak temperature: 100° C.): 10 parts by mass Ester wax B: 7 parts by mass Coloring agent X1: 5.25 parts by mass Coloring agent Y: 5.25 parts by mass Charge control agent: 1.2 parts by mass The composition of the external additives is as follows.

Hydrophobic silica A: 0.7 parts by mass

Hydrophobic silica B: 0.9 parts by mass

Hydrophobic titanium oxide: 0.7 parts by mass

Comparative Example 8

A toner of Comparative Example 8 was produced in the same manner as in Example 1 except that the following toner particle starting materials and external additives were used. Incidentally, the toner particles had a volume average particle diameter of 7 μm and a Tg of 37.0° C.

The composition of the toner particle starting materials is as follows.

Amorphous polyester resin: 67 parts by mass

Crystalline polyester resin (endothermic peak temperature: 105° C.): 10 parts by mass Ester wax B: 10 parts by mass Coloring agent X1: 8.4 parts by mass Coloring agent Y: 3.6 parts by mass Charge control agent: 1 part by mass The composition of the external additives is as follows.

Hydrophobic silica A: 0.8 parts by mass

Hydrophobic silica B: 0.9 parts by mass

Hydrophobic titanium oxide: 0.6 parts by mass

From each of the toners of Examples 1 to 28 and Comparative Examples 1 to 8, an ester wax was extracted, and the carbon number distribution of ester compounds in the ester wax was measured as follows.

A measurement method for the carbon number distribution of ester compounds in the ester wax extracted from each toner will be described.

0.5 g of the toner was weighed and put into an Erlenmeyer flask. To the Erlenmeyer flask, 2 mL of methylene chloride was added to dissolve the toner therein. Further, 4 mL of hexane was added to the Erlenmeyer flask to prepare a mixed liquid. The mixed liquid was filtered and separated into a filtrate and insoluble matter. The solvent was distilled off from the filtrate in a nitrogen stream, whereby a deposit was obtained. For this deposit, FD-MS measurement was performed in the same manner as in the case of the ester waxes A to H, and the carbon number distribution of ester compounds in the ester wax extracted from the toner was measured. The measurement results are shown in FIGS. 3 and 4.

The glass transition temperature (Tg) of each of the toners of Examples 1 to 28 and Comparative Examples 1 to 8 was measured as follows. Further, the storage stability of each of the above toners was evaluated as follows.

A measurement method for the glass transition temperature (Tg) will be described.

Tg was measured using DSC (DSC Q2000, manufactured by TA Instruments, Inc.). The measurement conditions are as follows.

Sample amount: 5 mg

Lid and pan: made of alumina

Temperature raising rate: 10° C./min

Measurement method: A sample is heated from 20° C. to 200° C. Thereafter, the sample is cooled to 20° C. or lower. Then, the sample is heated again, and the point of intersection of a straight line obtained by extending a base line on the lower temperature side of a curve measured within a temperature range from 20 to 60° C. to the higher temperature side and a tangent line at the inflection point of the curve is defined as Tg.

A toner having a lower Tg is advantageous to the low-temperature fixation, however, if the Tg of the toner is too low, the storage stability tends to be deteriorated. The Tg of the toner is preferably 20° C. or higher, more preferably 33° C. or higher.

An evaluation method for storage stability will be described.

15 g of each toner was left at 55° C. for 10 hours, and then, sieved through a 42-mesh sieve. The toner remaining on the sieve was weighed. It can be evaluated that as the amount of the toner remaining on the sieve is smaller, the toner has excellent storage stability. A case where the amount of the toner remaining on the sieve was 3.0 g or less was evaluated as "passed (P)", and a case where the amount of the toner remaining on the sieve exceeded 3.0 g was evaluated as "failed (F)".

Subsequently, 6 parts by mass of each of the toners of Examples 1 to 28 and Comparative Examples 1 to 8 and 100 parts by mass of a silicone resin-surface coated ferrite carrier having an average particle diameter of 40 μm were stirred in a turbula mixer, whereby a developer was prepared. By using this developer, the color reproducibility, light resistance, coloring power, low-temperature fixability, and long life property of each of the above toners were evaluated as follows.

An evaluation method for the color reproducibility will be described.

Each of the developers of the respective Examples was housed in a toner cartridge. The toner cartridge was placed in commercially available e-studio 6530c (manufactured by Toshiba Tec Corporation), and by using this, a solid image at a toner deposition amount on paper of 0.40 mg/cm$^2$ was obtained. The L* value, the a* value, and the b* value in the L*a*b* color system of the obtained solid image were measured by X-Rite 938. A case where the solid image had an L* value in the range of 47 to 60, an a* value in the range of 70 or more, and a b* value in the range of −5 to 13 was evaluated as "passed (P)", and a case where at least one of the L* value, the a* value, and the b* value did not satisfy the above range was evaluated as "failed (F)".

An evaluation method for the light resistance will be described.

Each of the developers of the respective Examples was housed in a toner cartridge. The toner cartridge was placed in commercially available e-studio 6530c (manufactured by Toshiba Tec Corporation), and by using this, a solid image with an image density of 1.0 was obtained. The image density was measured by a Macbeth 19I densitometer. By using a suntest CPS+ (manufactured by ATLAS GmbH), the obtained solid image was irradiated with light at an illumination of 550 W/m$^2$ for 100 hours. The image density after the light irradiation was measured, and the image density maintenance ratio was calculated according to the following formula.

Image density maintenance ratio=(image density after light irradiation/image density before light irradiation)×100

By using this image density maintenance ratio as an index, the light resistance of the toner was evaluated. A case where the image density maintenance ratio was 90% or more was evaluated as "passed (P)" for the light resistance, and a case where the image density maintenance ratio was less than 90% was evaluated as "failed (F)" for the light resistance.

An evaluation method for the coloring power will be described.

Each of the developers of the respective Examples was housed in a toner cartridge. The toner cartridge was placed in commercially available e-studio 6530c (manufactured by Toshiba Tec Corporation), and a solid image at a toner deposition amount on paper of 0.45 mg/cm$^2$ was obtained. The solid image was measured by a Macbeth 19I densitometer. It can be evaluated that as the measurement value is higher, the toner has excellent coloring power. A case where the measurement value was 1.2 or more was evaluated as "passed (P)" for the coloring power, and a case where the measurement value was less than 1.2 was evaluated as "failed (F)" for the coloring power.

An evaluation method for the low-temperature fixability will be described.

Each of the developers of the respective Examples was housed in a toner cartridge. The toner cartridge was placed in e-studio 6530c (manufactured by Toshiba Tec Corporation) The e-studio 6530c was modified so that the toner fixing temperature can be changed in increments or decrements of 0.1° C. in the range from 100 to 200° C.

The fixing temperature was set to 150° C., and a solid image at a toner deposition amount of 1.5 mg/cm$^2$ was formed on 10 sheets of paper. When image peeling due to offset or an unfixed toner did not occur in all the solid images on the 10 sheets of paper, the set temperature was decreased by 1° C., and a solid image was obtained in the same manner as described above. This procedure was repeated, and the lower limit temperature of the fixing temperature at which image peeling did not occur in the solid image was determined, and this lower limit temperature was defined as the lowest fixing temperature of the toner. A case where the lowest fixing temperature was 125° C. or lower was evaluated as "passed (P)" for the low-temperature fixability of the toner, and a case where the lowest fixing temperature exceeded 125° C. was evaluated as "failed (F)" for the low-temperature fixability of the toner.

An evaluation method for the long life property will be described.

Each of the developers of the respective Examples was housed in a toner cartridge. The toner cartridge was placed in commercially available e-studio 6530c (manufactured by Toshiba Tec Corporation), and by using this, an original document (A4 size) with a coverage rate of 8.0% was continuously copied on 300,000 sheets of paper. Thereafter, the toner accumulated in a lower part of a magnet roller of the developing device was sucked by a cleaner, and the mass of the sucked toner was measured. The mass of the toner was defined as the toner scattering amount, and by using this toner scattering amount as an index, the long life property of the toner was evaluated. As the toner scattering amount is smaller, the members in the main body are less fouled, and therefore, it can be evaluated that the toner has an excellent long life property. A case where the toner scattering amount was 170 mg or less was evaluated as "passed (P)" for the long life property, and a case where the toner scattering amount exceeded 170 mg was evaluated as "failed (F)" for the long life property.

The evaluation results of the color reproducibility, light resistance, coloring power, low-temperature fixability, long life property, and storage stability of each of the toners of Examples 1 to 28 and Comparative Examples 1 to 8, and the measurement results of Tg are shown in FIGS. 5 and 6.

The toners of Examples 1 to 28 passed the evaluation for all the color reproducibility, light resistance, coloring power, low-temperature fixability, storage stability, and long life property. Further, the Tg of each of the toners of the respective Examples was 33° C. or higher.

The toners of Examples 1 to 28 contain any of the ester waxes A to D, and therefore have excellent low-temperature fixability. Further, the ester wax is hardly deposited from the toner particles when the toners are left at a high temperature, and therefore, the toners have excellent storage stability. In Examples 1 to 28, the mass ratio of a pigment categorized in C.I. Pigment Red 48 to C.I. Pigment Red 122 in the coloring agent is set within a specific range. Further, in Examples 1 to 28, by using any of the ester waxes A to D, the dispersibility of C.I. Pigment Red 122 is enhanced, and therefore, toners in which the entire coloring agent containing C.I. Pigment Red 122 and a pigment categorized in C.I. Pigment Red 48 is favorably and uniformly dispersed are obtained. Due to this, the toners of Examples 1 to 28 have excellent color reproducibility, light resistance, and coloring power. Further, the deposition of the coloring agent on the surfaces of the toner particles is prevented, and therefore, the charging stability is improved, and the long life property becomes favorable. In Examples 1 to 28, by using any of the ester waxes A to D, the coloring agent can be uniformly and favorably dispersed even if a step of preparing a master batch and a step of performing a flushing treatment are not provided when the toner particles are produced. Due to this, the toner can be produced more simply, and the productivity is high.

On the other hand, the toners of Comparative Examples cannot simultaneously have all the properties of color reproducibility, light resistance, coloring power, low-temperature fixability, storage stability, and long life property.

In the ester wax E used in Comparative Example 1, the content of an ester compound having a carbon number of ($C_n$) exceeds 58% by mass and the d/a ratio is less than 0.619. The ester wax E has a sharp carbon number distribution of ester compounds in the ester wax E. Due to this, the dispersibility of the coloring agent and the ester wax E is poor, and the coloring agent and the ester wax E are deposited, and thus, the color reproducibility, low-temperature fixability, storage stability, and long life property of the toner are deteriorated. In the ester wax F used in Comparative Example 2, the content of an ester compound having a carbon number of ($C_n$) is less than 20% by mass, the content of ester compounds having a carbon number of 38 or less exceeds 10% by mass, and the d/a ratio exceeds 0.783. Due to this, the ester wax F is deposited, and the storage stability and long life property of the toner are deteriorated.

In the ester wax G used in Comparative Example 3, the d/a ratio is less than 0.619, and the carbon number distribution of ester compounds in the ester wax G is sharp. Due to this, the color reproducibility and low-temperature fixability are deteriorated.

In the ester wax H used in Comparative Example 4, the d/a ratio exceeds 0.783. Due to this, the ester wax H is deposited, and the low-temperature fixability and long life property are deteriorated.

In Comparative Examples 5 and 6, the mass ratio of the component (X) in the coloring agent is less than the lower limit. Due to this, sufficient color reproducibility cannot be obtained. In Comparative Example 5, also sufficient coloring power cannot be obtained.

In Comparative Examples 7 and 8, the mass ratio of the component (X) in the coloring agent exceeds the upper limit. Due to this, sufficient color reproducibility and light resistance cannot be obtained.

While certain embodiments have been described, these embodiments have been presented by way of example only, and are not intended to limit the scope of the inventions. Indeed, the novel embodiments described herein may be embodied in a variety of other forms, furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A toner, comprising toner particles containing a coloring agent, a binder resin, and an ester wax, wherein the coloring agent contains at least one pigment (X) selected from C.I. Pigment Red 48, C.I. Pigment Red 48:1, C.I. Pigment Red 48:2, C.I. Pigment Red 48:3, C.I. Pigment Red 48:4, and C.I. Pigment Red 48:5, and C.I. Pigment Red 122 (Y), the mass ratio of the component (X) to the component (Y) is as follows: X:Y=30:70 to 60:40, the ester wax is composed of two or more ester compounds represented by the following general formula (I) and having different carbon numbers, the content of an ester compound having a carbon number of ($C_n$) whose content in the ester wax is the highest is from 20 to 58% by mass of the total mass of the ester wax, and the content of ester compounds having a carbon number of 38 or less in the ester wax is 10% by mass or less of the total mass of the ester wax, and the ester wax satisfies the following formula (I):

$$R^1COOR^2 \quad (I)$$

wherein $R^1$ and $R^2$ in the formula (I) each represent an alkyl group, and the total carbon number of $R^1$ and $R^2$ is from 31 to 53, and $$0.619 \leq d/a \leq 0.783 \quad (1)$$

wherein a in the formula (1) represents the content of the ester compound having a carbon number of ($C_n$) in the ester wax, and d in the formula (1) represents the total content of an ester compound having a carbon number of ($C_n$−4) and an ester compound having a carbon number of ($C_n$−2) in the ester wax.

2. The toner according to claim 1, wherein the content of the coloring agent is from 4 to 12% by mass of the total mass of the toner particles.

3. The toner according to claim 1, wherein the $C_n$ is a carbon number of 40 to 48.

4. The toner according to claim 1, wherein the ester wax satisfies the following formula (2):

$$0.281 \leq c/a \leq 0.518 \quad (2)$$

wherein c in the formula (2) represents the content of the ester compound having a carbon number of ($C_n$−2) in the ester wax.

5. The toner according to claim 1, wherein the endothermic peak temperature of the ester wax as measured by a differential scanning calorimeter is from 60 to 75° C.

6. The toner according to claim 1, wherein the binder resin contains a crystalline polyester resin, the endothermic peak temperature of the ester wax as measured by a differential scanning calorimeter is from 60 to 75° C., and the endothermic peak temperature of the crystalline polyester resin as measured by a differential scanning calorimeter is from 78 to 110° C.

7. A toner cartridge, wherein the toner according to claim 1 is housed.

8. An image forming apparatus, wherein the toner according to claim 1 is housed.

9. A method for producing a toner which is a method for producing the toner according to claim 1, comprising:

mixing the coloring agent, the binder resin, and the ester wax, thereby obtaining a mixture;

melt-kneading the mixture, thereby obtaining a kneaded material; and pulverizing the kneaded material, thereby obtaining a pulverized material.

10. The method for producing a toner which is a method for producing the toner according to claim 1, comprising:

mixing the coloring agent, the binder resin, and the ester wax, thereby obtaining a mixture;

melt-kneading the mixture, thereby obtaining a kneaded material; and pulverizing the kneaded material, thereby obtaining a pulverized material, wherein the method does not include preparing a master batch containing the coloring agent, and performing a flushing treatment.

* * * * *